US009945535B2

(12) United States Patent
Magno et al.

(10) Patent No.: US 9,945,535 B2
(45) Date of Patent: Apr. 17, 2018

(54) LUMINAIRE INCLUDING A GEOMETRIC SOLID HAVING TWO GEOMETRIC SOLID PORTIONS

(71) Applicants: John N. Magno, Red Bank, NJ (US); Gene C. Koch, Toms River, NJ (US); Christopher Magno, Red Bank, NJ (US)

(72) Inventors: John N. Magno, Red Bank, NJ (US); Gene C. Koch, Toms River, NJ (US); Christopher Magno, Red Bank, NJ (US)

(73) Assignee: AMERITECH LLC, Red Bank, NJ (US)

( * ) Notice: Subject to any disclaimer, the term of this patent is extended or adjusted under 35 U.S.C. 154(b) by 113 days.

(21) Appl. No.: 15/048,711

(22) Filed: Feb. 19, 2016

(65) Prior Publication Data

US 2017/0002986 A1 Jan. 5, 2017

Related U.S. Application Data

(60) Provisional application No. 62/118,824, filed on Feb. 20, 2015, provisional application No. 62/240,625, filed on Oct. 13, 2015.

(51) Int. Cl.
*F21V 7/00* (2006.01)
*F21Y 115/10* (2016.01)

(52) U.S. Cl.
CPC ..... *F21V 7/005* (2013.01); *F21V 7/0041* (2013.01); *F21Y 2115/10* (2016.08)

(58) Field of Classification Search
CPC .... F21V 7/005; F21V 7/0091; F21V 2200/00; F21V 2200/10; F21V 2200/13;
(Continued)

(56) References Cited

U.S. PATENT DOCUMENTS 6,851,834 B2 * 2/2005 Leysath ..... F21S 8/04 362/240
7,334,933 B1 * 2/2008 Simon ..... F21V 7/0091 362/328

(Continued)

OTHER PUBLICATIONS

International Search Report, dated Oct. 28, 2016 for corresponding International Application PCT/US2016/047178.

(Continued)

*Primary Examiner* — Robert May
(74) *Attorney, Agent, or Firm* — K&L Gates LLP

(57) ABSTRACT

A luminaire. The luminaire includes a geometric solid. The geometric solid has a length and includes a first geometric solid portion which includes an optically clear material and a second geometric solid portion which includes the optically clear material, wherein the first and second geometric solid portions are conjoined. The luminaire further includes a cavity defined by the first and second geometric solid portions, a plurality of discrete light sources positioned to emit light into the cavity, a first aperture positioned to allow a first portion of light in the cavity to pass into the first geometric solid portion, and a second aperture positioned to allow a second portion of the light in the cavity to pass into the second geometric solid portion.

19 Claims, 18 Drawing Sheets

(58) Field of Classification Search
CPC ..... F21V 2200/15; F21V 2200/17; F21V 2200/20; F21V 2200/30; F21V 2200/40; F21Y 2115/10; F21Y 2103/10
See application file for complete search history.

(56) References Cited

U.S. PATENT DOCUMENTS

| | | | | |
|---|---|---|---|---|
| 7,494,246 | B2 | 2/2009 | Harbers et al. | |
| 7,980,728 | B2 | 7/2011 | Ramer et al. | |
| 8,028,537 | B2 | 10/2011 | Hanley et al. | |
| 8,198,109 | B2 | 6/2012 | Lerman | |
| 8,573,823 | B2 * | 11/2013 | Dau | G02B 6/0045 362/222 |
| 9,068,715 | B2 * | 6/2015 | Van Der Sijde | F21S 8/04 |
| 9,110,209 | B2 * | 8/2015 | Blessitt | G02B 6/0055 |
| 9,206,956 | B2 * | 12/2015 | Speier | F21S 8/04 |
| 9,625,636 | B2 * | 4/2017 | Durkee | G02B 6/0021 |
| 2013/0188347 | A1 | 7/2013 | Bryan et al. | |
| 2013/0308294 | A1 | 11/2013 | Nezu et al. | |

OTHER PUBLICATIONS

Written Opinion dated Oct. 28, 2016 for corresponding International Application PCT/US2016/047178.

* cited by examiner

LUMINAIRE INCLUDING A GEOMETRIC SOLID HAVING TWO GEOMETRIC SOLID PORTIONS

CROSS-REFERENCE TO RELATED APPLICATIONS

This application claims the benefit under 35 U.S.C. § 119(e) of the earlier filing date of U.S. Provisional Patent Application No. 62/118,824 filed on Feb. 20, 2015 and of the earlier filing date of U.S. Provisional Patent Application No. 62/240,625 filed on Oct. 13, 2015, the contents of each of which are hereby incorporated by reference in their entireties.

BACKGROUND

This application discloses an invention which is related, generally and in various aspects, to a luminaire which includes light emitting diodes.

Light emitting diodes (LEDs) are an energy efficient, highly reliable technology that is finding considerable utility in replacing fluorescent lamps in many lighting applications. An issue with LEDs that limits their utility is that they are point sources as opposed to continuous sources of light. This creates unacceptable glare or poor aesthetics in many lighting applications. Prior to the invention disclosed herein, there was no known luminaire which could efficiently convert the point source illumination from LEDs into a light output distribution similar to that of fluorescent lamps. That is to say, there was not a known LED-based luminaire which has an even distribution of luminance across its luminous surface and whose form factor is similar to that of fluorescent lamps.

BRIEF DESCRIPTION OF THE DRAWINGS

The novel features of the aspects described herein are set forth with particularity in the appended claims. The aspects, however, both as to organization and methods of operation may be better understood by reference to the following description, taken in conjunction with the accompanying drawings.

DETAILED DESCRIPTION

Figure 1B:
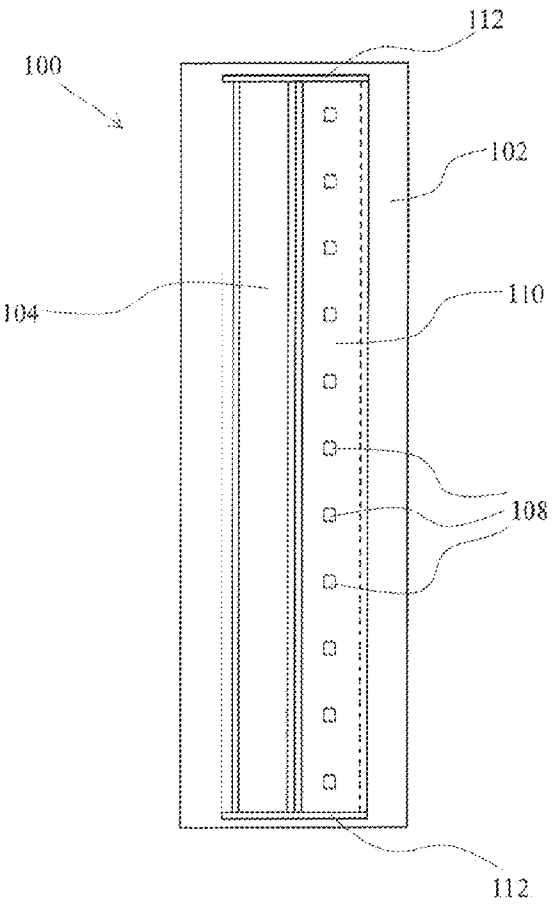
FIGS. 1A and 1B illustrate various aspects of a luminaire.

It is to be understood that at least some of the figures and descriptions of the invention have been simplified to illustrate elements that are relevant for a clear understanding of the invention, while eliminating, for purposes of clarity, other elements that those of ordinary skill in the art will appreciate may also comprise a portion of the invention. However, because such elements are well known in the art, and because they do not facilitate a better understanding of the invention, a description of such elements is not provided herein.

In the following detailed description, reference is made to the accompanying drawings, which form a part hereof. In the drawings, similar symbols and reference characters typically identify similar components throughout several views, unless context dictates otherwise. The illustrative aspects described in the detailed description, drawings and claims are not meant to be limiting. Other aspects may be utilized, and other changes may be made, without departing from the scope of the technology described herein.

The following description of certain examples of the technology should not be used to limit its scope. Other examples, features, aspects, embodiments and advantages of the technology will become apparent to those skilled in the art from the following description, which is by way of illustration, one of the best modes contemplated for carrying out the technology. As will be realized, the technology described herein is capable of other different and obvious aspects, all without departing from the technology. Accordingly, the drawings and descriptions should be regarded as illustrative in nature and not restrictive.

It is further understood that any one or more of the teachings, expressions, aspects, embodiments, examples, etc. described herein may be combined with any one or more of the other teachings, expressions, aspects, embodiments, examples, etc. that are described herein. The following described teachings, expressions, aspects, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

Before explaining the various aspects of the luminaire in detail, it should be noted that the various aspects disclosed herein are not limited in their application or use to the details of construction and arrangement of parts illustrated in the accompanying drawings and description. Rather, the disclosed aspects may be positioned or incorporated in other aspects, embodiments, variations and modifications thereof, and may be practiced or carried out in various ways. Accordingly, aspects of the luminaire disclosed herein are illustrative in nature and are not meant to limit the scope or application thereof. Furthermore, unless otherwise indicated, the terms and expressions employed herein have been chosen for the purpose of describing the aspects for the convenience of the reader and are not meant to limit the scope thereof. In addition, it should be understood that any one or more of the disclosed aspects, expressions of aspects, and/or examples thereof, can be combined with any one or more of the other disclosed aspects, expressions of aspects, and/or examples thereof, without limitation.

Also, in the following description, it is to be understood that terms such as inward, outward, upward, downward, above, below, left, right, interior, exterior and the like are words of convenience and are not to be construed as limiting terms. Terminology used herein is not meant to be limiting insofar as devices described herein, or portions thereof, may be attached or utilized in other orientations. The various aspects will be described in more detail with reference to the drawings.

Figure 1A:
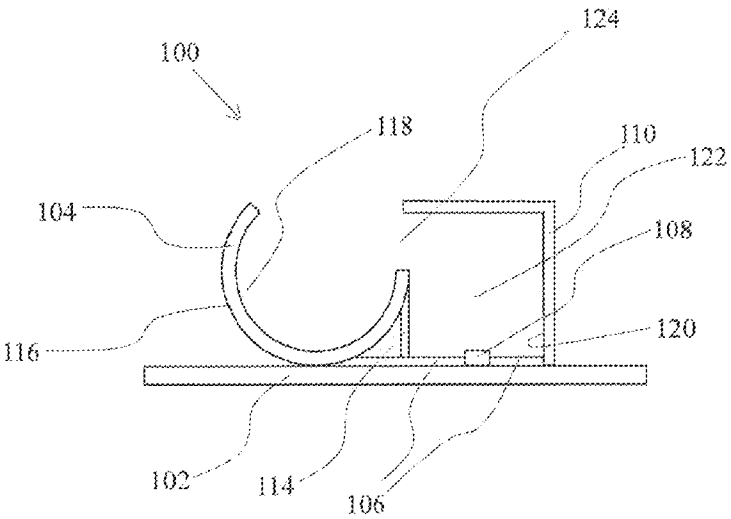

FIGS. 1A and 1B illustrate various aspects of a luminaire 100. FIG. 1A is a cross-section view of the luminaire 100 and FIG. 1B is a plan view of the luminaire 100. The luminaire 100 includes a substrate 102, a reflector 104, a reflective sheet or coating 106, a plurality of discrete sources of light 108, a reflector 110 and reflective end panels 112 (See FIG. 1B). According to various aspects, the luminaire 100 may also include a reflective panel 114 as shown in FIG. 1A.

The substrate 102 may include any suitable material. According to various aspects the substrate 102 is a printed circuit board. The reflector 104 is positioned on the substrate 102, has a hollow cylindrical-like cross-section, and includes an "exterior" surface 116 and an "interior" curved reflective surface 118. The reflector 104 may be specularly reflective, diffusely reflective, or a combination of specularly and diffusely reflective. The reflector 104 may include any suitable materials. For example, according to various aspects, the reflector 104 includes a plastic material which is loaded with a reflective pigment. According to various aspects, the "interior" of the reflector 104 may be coated with White Reflectance Coating 83-890 available from Edmunds Optics, Inc., Barrington, N.J. According to other aspects, the reflector 104 may include a non-reflective plastic or metal which is connected to, coated on or adhered to its "interior" surface 118 with a reflective coating. According to other aspects, the reflector 104 may include a reflective adhesive-backed tape (e.g., White Optics film F-16A available from WhiteOptics, LLC, New Castle, Del.) which is adhered to a non-reflective plastic or metal. According to various aspects, the "exterior" surface 116 of the reflector 104 is adhered to the substrate 102, and any suitable adhesive may be utilized to adhere the reflector 104 to the substrate 102.

The reflective sheet or coating 106 is positioned on the substrate 102. The reflective sheet or coating 106 may be specularly reflective, diffusely reflective, or a combination of specularly and diffusely reflective. The reflective sheet or coating 106 may include any suitable material. For example, according to various aspects, the reflective sheet or coating 106 may include the same material(s) as the reflector 104. According to various aspects, the reflective sheet or coating 106 is a reflective adhesive-backed tape which is adhered to the substrate 102, and any suitable adhesive may be utilized to adhere the reflective sheet or coating 106 to the substrate 102. According to other aspects, the reflective sheet or coating 106 is formed on the substrate 102.

The discrete sources of light 108 are positioned on the substrate 102 and may be any suitable type of discrete sources of light 108. For example, according to various aspects, the discrete sources of light 108 may be any suitable type of light emitting diodes. For purposes of simplicity, for the luminaire 100 and the other luminaires described hereinafter, the discrete sources of light will hereinafter be described in the context of light emitting diodes. However, it will be appreciated that the discrete sources of light may be other than light emitting diodes. According to various aspects, the light emitting diodes 108 are adhered to the substrate 102, and any suitable adhesive or metallic solder may be utilized to adhere the light emitting diodes 108 to the substrate 102. Although the plurality of light emitting diodes 108 are shown in FIG. 1B as being arranged in an "aligned" pattern (e.g., a longitudinal axis would pass through a center of each light emitting diode 108), it will be appreciated that according to other aspects, the plurality of light emitting diodes 108 may be arranged in a different pattern. For example, the light emitting diodes 108 may be arranged in a staggered or offset configuration.

The reflector 110 is positioned on the substrate 102, and includes a reflective "interior" surface 120 which is diffusely reflective. In other words, a ray of light incident on the reflective "interior" surface 120 is reflected at many angles from the reflective "interior" surface 120. For the aspects shown in FIGS. 1A-1B, the reflector 110 has a substantially L-shaped cross-section and its respective surfaces are substantially planar. The reflector 110 may include any suitable materials. For example, according to various aspects, the reflector 110 includes the same material(s) as the reflector 104 and/or the reflective sheet or coating 106. According to various aspects, the reflector 110 includes a plastic material which is loaded with a reflective pigment. According to various aspects, Bayer Makrolon white RW polycarbonate may be used to fabricate the reflector 104 and the reflector 110. According to other aspects, the reflector 110 may include a non-reflective plastic or metal which is coated on its "interior" surface 120 with a reflective coating.

The reflective end panels 112 are positioned on the substrate 102 and against respective "ends" of the reflector 104, the reflective sheet or coating 106, the reflector 110 and the reflective panel 114. The reflective end panels 112 may be specularly reflective, diffusely reflective, or a combination of specularly and diffusely reflective. The reflective end panels 112 may include any suitable materials. For example, according to various aspects, the reflective panels 112 include the same material(s) as the reflector 104 and/or the reflective sheet or coating 106. According to various aspects, the reflective panels 112 are adhered to the substrate 102, the reflector 104, the reflective sheet or coating 106, the reflector 110 and/or the reflective panel 114, and any suitable adhesive may be utilized to adhere to the reflective end panels 112 to the substrate 102, the reflector 104, the reflective sheet or coating 106, the reflector 110 and/or the reflective panel 114.

The optional reflective panel 114 is positioned on the reflective sheet or coating 106 and against the reflector 104 and/or the reflective end panels 112. The reflective panel 114 may be specularly reflective, diffusely reflective, or a combination of specularly and diffusely reflective. The reflective panel 114 may include any suitable materials. For example, according to various aspects, the reflective panel 114 includes the same material(s) as the reflector 104, the reflective sheet or coating 106 and/or the reflective end panels 112. According to various aspects, the reflective panel 114 is adhered to the reflective sheet or coating 106, the "exterior" surface 116 of the reflector 104 and/or the reflective end panels 112, and any suitable adhesive may be utilized to adhere the reflective panel 114 sheet to the reflective sheet or coating 106, the "exterior" surface 116 of the reflector 104 and/or the reflective end panels 112.

Collectively, the reflective sheet or coating 106, the reflector 110, the reflective end panels 112 and the reflective panel 114 cooperate to define a reflective cavity 122. For aspects which do not include the optional reflective panel 114, the combination of the reflector 104, the reflective sheet or coating 106, the reflector 110 and the reflective end panels 112 cooperate to define the reflective cavity 122. Given the substantially L-shaped cross-section of the reflector 110, it will be appreciated that the cross-section of the reflective cavity 122 is substantially square or rectangular. Also, the reflector 104, the reflector 110 and the reflective end panels 112 collectively cooperate to define an aperture 124.

According to various aspects, the reflective cavity 122 is filled with a transparent material, and the transparent material may be any suitable type of transparent material. For such aspects, the reflective sheet or coating 106, the reflector 110, the reflective end panels 112 and the reflective panel 114 may be reflective coatings on the transparent cavity material, or reflective films adhered to the transparent cavity material.

According to various aspects, two or more of (a) the reflective sheet or coating 106, (b) the reflector 110, (c) the reflective end panels 112 and (d) the reflective panel 114 may be combined together as a single piece of reflective material.

In operation, the light emitting diodes 108 emit light into the reflective cavity 122, thereby illuminating the reflective cavity 122. The light emitted into the reflective cavity 122 is scattered off the diffusely reflective "interior" surface 120 of the reflector 110. If the reflective sheet or coating 106, the reflective end panels 112 and/or the reflective panel 114 are diffusely rather than specularly reflective, the light emitted into the reflective cavity 122 is also scattered off the "interior" surfaces of the reflective sheet or coating 106, the reflective end panels 112 and/or the reflective panel 114. A first portion of the scattered light passes through the aperture 124 and onto the reflector 104, where it is then reflected by the reflective "interior" surface 118 of the reflector 104 into the surrounding environment. A second portion (e.g., the remaining portion) of the scattered light is retained in the reflective cavity 122 where it is reflected by the "interior" surfaces of the reflective cavity 122 (e.g., the "interior" surfaces of the reflective sheet or coating 106, the reflective end panels 112 and the reflective panel 114).

A first portion of the reflected light passes through the aperture 124 and onto the reflector 104. A second portion (e.g., the remaining portion) of the reflected light is retained in the reflective cavity 122 where it is reflected by the "interior" surfaces of the reflective cavity 122 (e.g., the "interior" surfaces of the reflective sheet or coating 106, the reflective end panels 112 and the reflective panel 114). This reflection process repeats itself until most if not all of the light emitted by the light emitting diode 108 is passed through the aperture 124 and onto the reflector 104. The light in the reflector 104 is then reflected by the reflective "interior" surface 118 of the reflector 104 into the surrounding environment.

Although the reflective cavity 122 is shown as having a square or rectangular cross-section in FIG. 1A, it will be appreciated that according to other aspects, the reflective cavity 122 may have any cross-sectional shape as long as the reflective cavity 122 includes diffusely reflecting walls which operate to feed light in a relatively uniform distribution through the aperture 124. The cross-sectional shape of the reflective cavity 122 can be adjusted by introducing curvature in its walls (e.g., reflector 110) or otherwise changing the shape of the reflective cavity 122 so as to optimize the uniformity of light output through the aperture 124. In addition, the curvature and extent of the curvature of the reflector 104, its orientation relative to the aperture 124, the "width" of the aperture 124, and the position and orientation of the aperture 124 relative to reflector 104 may all be varied so as to optimize the uniformity of light output by the reflector 104 and the light's angular distribution. According to other aspects, further tuning of the spatial uniformity of the light output can be realized by varying the cross-sectional shape of the reflective cavity 122 along its longitudinal axis (e.g., the axis containing the centers of the light emitting diodes 108 positioned within the reflective cavity 122 as shown in FIG. 1B).

Figure 2:
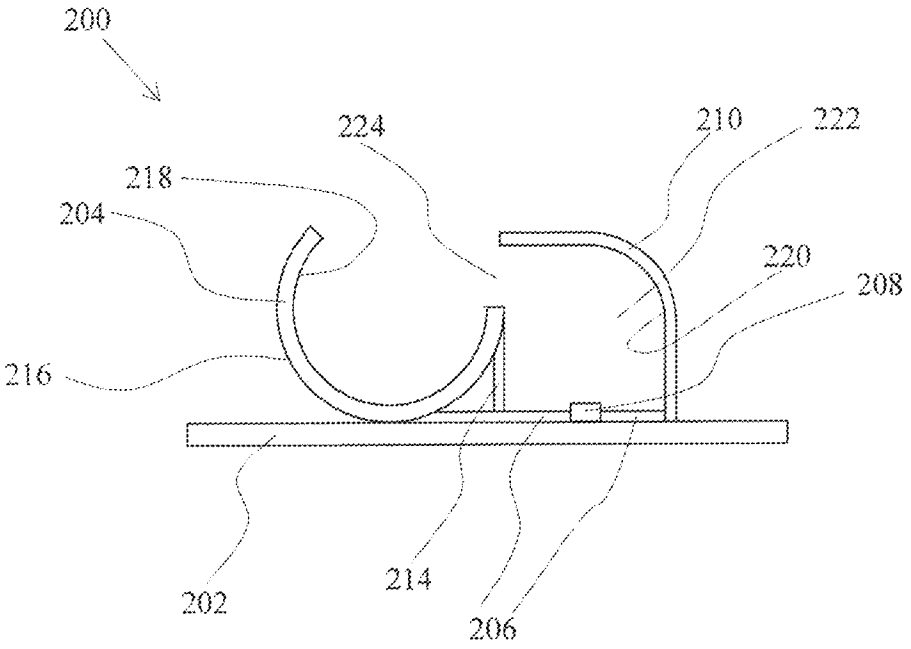
FIG. 2 illustrates other aspects of a luminaire.

FIG. 2 illustrates a cross-section of another luminaire 200 according to various aspects. The luminaire 200 is similar to the luminaire 100 of FIG. 1, but is different. The luminaire 100 includes a substrate 202, a reflector 204, a reflective sheet or coating 206, a plurality of light emitting diodes 208 (only one of which is shown), a reflector 210 and reflective end panels 212 (not shown). According to various aspects, the luminaire 100 may also include a reflective panel 214 as shown in FIG. 2.

The substrate 202, the reflector 204, the reflective sheet or coating 206, the light emitting diodes 208, the reflective end panels 212 and the reflective panel 214 may be similar to or identical to the substrate 102, the reflector 104, the reflective sheet or coating 106, the light emitting diodes 108, the reflective end panels 112 and the reflective panel 114 described hereinabove.

The reflector 210 is similar to the reflector 110 but is different in that the reflector 210 includes a diffusely reflective "interior" surface 220 which includes at least one curved portion along its "length". The reflective cavity 222 is similar to the reflective cavity 122, but is different in that due to the curved portion of the diffusely reflective "interior" surface 220 of the reflector 210, the cross-sectional shape of the reflective cavity 222 is different than the cross-sectional shape of the reflective cavity 122. According to various aspects, the aperture 224 can be the same as the aperture 124. According to other aspects, the aperture 224 can be different from the aperture 124. For example, if the "upper left" portion of the reflective cavity 222 is shaped different from the "upper left" portion of the reflective cavity 122, the aperture 224 will be different from the aperture 124.

According to various aspects, the reflective cavity 222 is filled with a transparent material, and the transparent material may be any suitable type of transparent material. For such aspects, the reflective sheet or coating 206, the reflector 210, the reflective end panels 212 and the reflective panel 214 may be reflective coatings on the transparent cavity material, or reflective films adhered to the transparent cavity material.

The cross-sectional shape of the reflective cavity 222 can be adjusted by introducing more or less curvature in its walls (e.g., reflector 210) or otherwise changing the shape of the reflective cavity 222 so as to optimize the uniformity of light output through the aperture 224. In addition, the curvature and extent of the curvature of the reflector 204, its orientation relative to the aperture 224, the "width" of the aperture 224, and the position and orientation of the aperture 224 relative to the reflector 204 may all be varied so as to optimize the uniformity of light output by the reflector 204 and the light's angular distribution. According to other aspects, further tuning of the spatial uniformity of the light output can be realized by varying the cross-sectional shape of the reflective cavity 222 along its longitudinal axis (e.g., the axis containing the centers of the light emitting diodes 208 positioned within the reflective cavity 222).

According to various aspects, two or more of (a) the reflective sheet or coating 206, (b) the reflector 210, (c) the reflective end panels 212 and (d) the reflective panel 214 may be combined together as a single piece of reflective material.

It will be appreciated that due to the respective configurations of the luminaires 100, 200, the light output from the luminaires 100, 200 may not be symmetric with respect to a longitudinal axis (not shown) of the reflector 104 (or of the reflector 204).

Figure 3B:
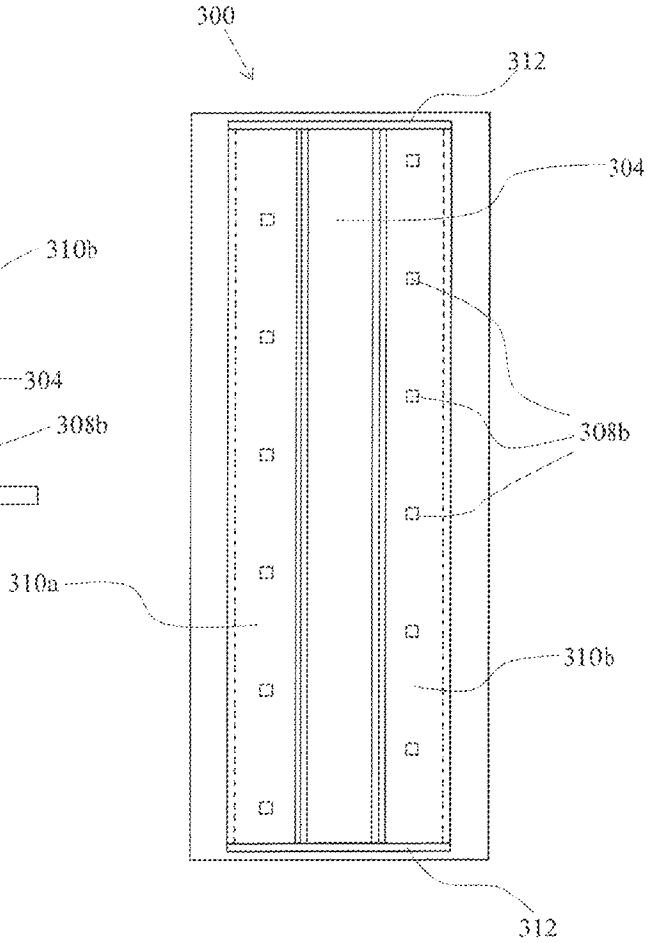
FIGS. 3A and 3B illustrate yet other aspects of a luminaire.
Figure 3A:
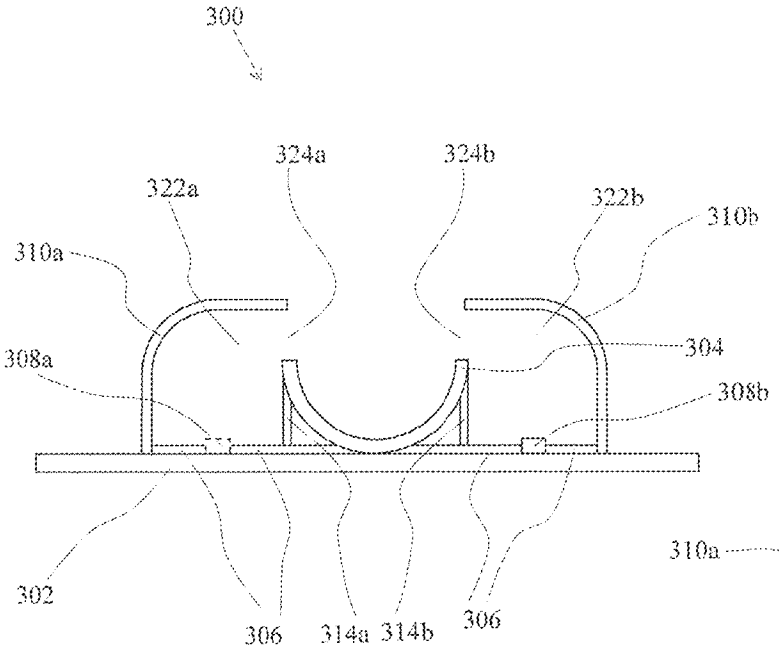

FIGS. 3A-3B illustrate various aspects of another luminaire 300. FIG. 3A is a cross-section view of the luminaire 300 and FIG. 3B is a plan view of the luminaire 300. The luminaire 300 is similar to the luminaire 200, but is different. The luminaire 300 includes a substrate 302, a reflector 304, a reflective sheet or coating 306, a first plurality of light emitting diodes 308*a* and a second plurality of light emitting diodes 308*b*, a first reflector 310*a* and a second reflector 310*b*, and reflective end panels 312 (See FIG. 3B). According to various aspects, the luminaire 300 may also include a first reflective panel 314*a* and a second reflective panel 314*b* as shown in FIG. 3. For the aspects shown in FIGS. 3A-3B, the light exiting the luminaire 300 can be symmetric with respect to a longitudinal axis (not shown) of the reflector 304.

The substrate 302, the reflector 304, the reflective sheet or coating 306, the light emitting diodes 308*a*, 308*b*, the reflective end panels 312 and the reflective panel 314 may be similar to or identical to the substrate 102, the reflector 104, the reflective sheet or coating 106, the light emitting diodes 108, the reflective end panels 112 and the reflective panel 114 described hereinabove.

The reflector 304 is similar to the reflector 204 but is different. In contrast to the reflector 204, which resembles approximately 62.5% of a hollow cylinder (approximately 37.5% of a hollow cylinder is not present), the reflector 304 resembles approximately 50% of a hollow cylinder (approximately 50% of a hollow cylinder is not present). The first reflector 310*a* and the second reflector 310*b* are similar to the reflector 210, but the first reflector 310*a* is positioned to the "left" of the reflector 304 and the second reflector 310*b* is positioned to the "right" of the reflector 304.

The first reflective cavity 322*a* and the second reflective cavity 322*b* are similar to the reflective cavity 222, but the first reflective cavity 322*a* is positioned to the "left" of the reflector 304 and the second reflective cavity 322*b* is positioned to the "right" of the reflector 304. The first aperture 324*a* and the second aperture 324*b* are similar to the aperture 224, but the first aperture 324*a* is associated with the first cavity 324*a* and the second aperture 324*b* is associated with the second cavity 324*b*.

The first plurality of the light emitting diodes 308*a* and the second plurality of light emitting diodes 308*b* are similar to the light emitting diodes 208, but the first plurality of light emitting diodes 308*a* are positioned within the first reflective cavity 322*a* and the second plurality of the light emitting diodes 308*b* are positioned within the second reflective cavity 322*b*. As shown in FIG. 3B, the first and second pluralities of light emitting diodes 308*a*, 308*b* are arranged in a staggered pattern relative to one another. According to other aspects, the first and second pluralities of light emitting diodes 308*a*, 308*b* may be arranged in other patterns. For example, the first and second pluralities of light emitting diodes 308*a*, 308*b* may be "laterally" aligned relative to one another, one or more of the light emitting diodes 308*a* may be staggered relative to other of the light emitting diodes 308*a*, one or more of the light emitting diodes 308*b* may be staggered relative to other of the light emitting diodes 308*b*, etc. The first reflective panel 314*a* and the second reflective panel 314*b* are similar to the reflective panel 214, but the first reflective panel 314*a* is positioned at the "left" of the reflector 304 and the second reflective panel 314*b* is positioned at the "right" of the reflector 304.

According to various aspects, the first and second reflective cavities 322*a*, 322*b* are filled with a transparent material, and the transparent material may be any suitable type of transparent material. For such aspects, the reflective sheet or coating 306, the first and second reflectors 310*a*, 310*b*, the reflective end panels 312 and the first and second reflective panels 314 may be reflective coatings on the transparent cavity material, or reflective films adhered to the transparent cavity material.

The cross-sectional shape of the reflective cavities 322*a*, 322*b* can be adjusted by introducing more or less curvature in their walls (e.g., reflectors 310*a*, 310*b*) or otherwise changing the shape of the reflective cavities 322*a*, 322*b* so as to optimize the uniformity of light output through the apertures 324*a*, 324*b*. In addition, the curvature and extent of the curvature of the reflector 304, its orientation relative to the apertures 324*a*, 324*b*, the "width" of the apertures 324*a*, 324*b*, and the position and orientation of the apertures 324*a*, 324*b* relative to reflector 304 may all be varied so as to optimize the uniformity of light output by the reflector 304 and the light's angular distribution. According to other aspects, further tuning of the spatial uniformity of the light output can be realized by varying the cross-sectional shape of the reflective cavity 322*a* along its longitudinal axis (e.g., the axis containing the centers of the light emitting diodes 308*a* positioned within the reflective cavity 322*a*) and by varying the cross-sectional shape of the reflective cavity 322*b* along its longitudinal axis (e.g., the axis containing the centers of the light emitting diodes 308*b* positioned within the reflective cavity 322*b*).

According to various aspects, two or more of (a) the reflective sheet or coating 306, (b) the first and second reflectors 310*a*, 310*b*, (c) the reflective end panels 312 and (d) the first and second reflective panels 314*a*, 314*b* may be combined together as a single piece of reflective material.

Figure 4:
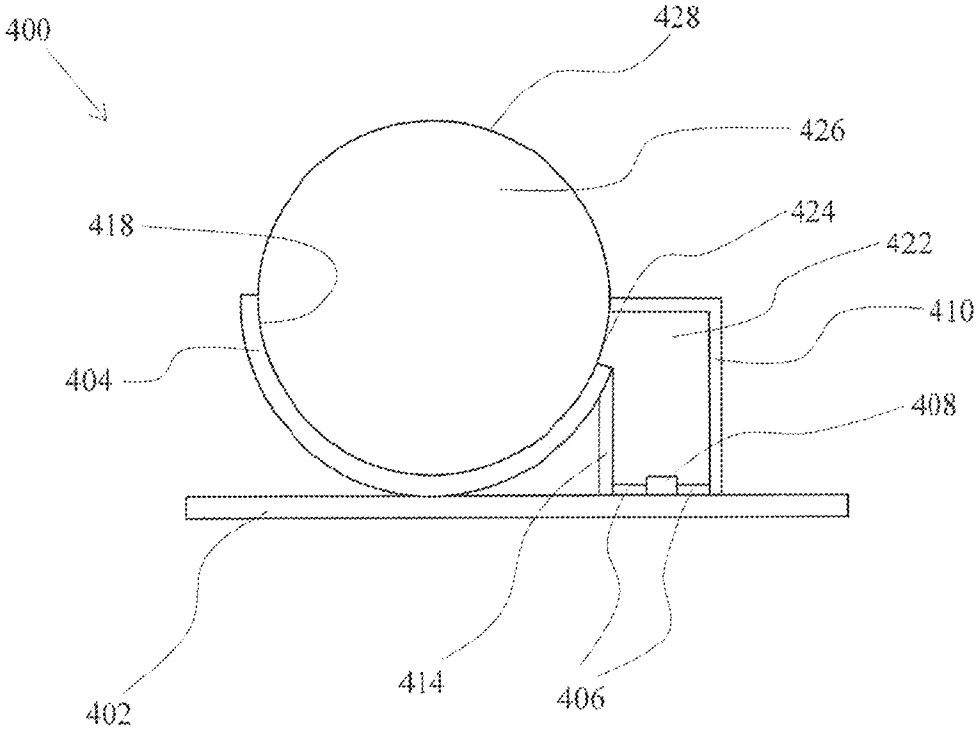
FIG. 4 illustrates yet other aspects of a luminaire.

FIG. 4 illustrates a cross-section of another luminaire 400 according to various aspects. The luminaire 400 is similar to the luminaire 100 but is different. The luminaire 400 includes a substrate 402, a reflector 404, a reflective sheet or coating 406, a plurality of light emitting diodes 408 (only one of which is shown), a reflector 410, reflective end panels 412 (not shown) and a geometric solid 426. According to various aspects, the luminaire 400 may also include a reflective panel 414 as shown in FIG. 4.

The substrate 402, the reflector 404, the reflective sheet or coating 406, the light emitting diodes 408, the reflector 410, the reflective end panels 412 and the reflective panel 414 may be similar to or identical to the substrate 102, the reflector 104, the reflective sheet or coating 106, the light emitting diodes 108, the reflector 110, the reflective end panels 112 and the reflective panel 114 described hereinabove.

The geometric solid 426 is made of a transparent/optically clear material such as, for example, a transparent/optically clear plastic material (e.g., acrylite M30 available from Evonik Cyro LLC, Parsippany, N.J.) or a transparent/optically clear glass material. For purposes of simplicity, as used hereinafter, the term transparent is meant to include optically clear. The reflector 404 is connected to, coated on or adhered to a portion of an "exterior" surface 428 of the geometric solid 426, and includes a reflective material. Although the geometric solid 426 is shown in FIG. 4 as having a circular cross-section, it will be appreciated that according to other aspects, the geometric solid 426 (or the geometric solids of other aspects described hereinafter) can have a cross-section other than circular. For example, according to various aspects, the geometric solid may have an elliptical cross-section, a parabolic cross-section, a hyperbolic cross-section, etc. According to various aspects, the geometric solid may have a cross-section, perpendicular to its long axis and substantially uniform along its length, which may be bounded by a closed composite line formed by the intersection of a plane perpendicular to the geometric solid's long axis with one or more curved surfaces or planes. Examples are (A) the intersection of the perpendicular plane with a plane and a circular cylinder, a plane and an elliptical cylinder, a plane and a parabolic cylinder, or a plane and a hyperbolic cylinder, (B) the intersection of the perpendicular plane with a circular cylinder and another circular cylinder, a circular cylinder and an elliptical cylinder, a circular cylinder and a parabolic cylinder, or a circular cylinder and a hyperbolic cylinder, (C) the intersection of the perpendicular plane with an elliptical cylinder and another elliptical cylinder, an elliptical cylinder and a parabolic cylinder, or an elliptical cylinder and a hyperbolic cylinder, (D) the intersection of the perpendicular plane with a parabolic cylinder and another parabolic cylinder or a parabolic cylinder and a hyperbolic cylinder, (E) the intersection of the perpendicular plane with two hyperbolic cylinders and (F) the intersection of the perpendicular plane with two other planes and a circular cylinder, with two other planes and an elliptical cylinder, with two other planes and a parabolic cylinder, or with two other planes and a hyperbolic cylinder, etc. The curved surfaces whose intersections with the perpendicular plane form the closed composite line that bounds the geometric solid's cross-section need not be limited to geometric solid's based on conic sections, but may be any continuous, ruled, curved surface. Additionally, although the geometric solid 426 has a uniform curvature, according to other aspects, the exterior surface 428 of the geometric solid 426 can include a compound curvature or have planar facets.

Collectively, the reflective sheet or coating 406, the reflector 410, the reflective end panels 412 and the reflective panel 414 cooperate to define the reflective cavity 422. For aspects which do not include the optional reflective panel 414, the combination of the reflector 404, the reflective sheet or coating 406, the reflector 410 and the reflective end panels 412 cooperate to define the reflective cavity 422.

Light emitted from the light emitting diodes 408 is diffusely reflected from one or more surfaces of the reflective cavity 422 in a manner similar to that described hereinabove, and the scattered/reflected light uniformly illuminates a portion of the exterior surface 428 of the geometric solid 426 which is located along the aperture 424. Light passing through the aperture 424 passes into the geometric solid 426, then is reflected from reflector 404 out into the surrounding environment. The transparent material of the geometric solid 426 assists in directing the light onto the "interior" surface 418 of the reflector 404 by means of reflection from the "exterior" surface 428 of the geometric solid 426. This increases the energy efficiency of the luminaire 400 as compared to the luminaire 100 and helps to further increase the spatial uniformity of the output light.

According to various aspects, the reflective cavity 422 is filled with a transparent material, and the transparent material may be any suitable type of transparent material. For such aspects, the reflective sheet or coating 406, the reflector 410, the reflective end panels 412 and the reflective panel 414 may be reflective coatings on the transparent cavity material, or reflective films adhered to the transparent cavity material.

The cross-sectional shape of the reflective cavity 422 can be adjusted by introducing curvature in its walls (e.g., reflector 410) or otherwise changing the shape of the reflective cavity 422 so as to optimize the uniformity of light output through the aperture 424. In addition, the curvature and extent of the curvature of the reflector 404, its orientation relative to the aperture 424, the "width" of the aperture 424, and the position and orientation of the aperture 424 relative to reflector 404 may all be varied so as to optimize the uniformity of light output by the reflector 404 and the light's angular distribution. According to other aspects, further tuning of the spatial uniformity of the light output can be realized by varying the cross-sectional shape of the reflective cavity 422 along its longitudinal axis (e.g., the axis containing the centers of the light emitting diodes 408 positioned within the reflective cavity 422).

According to various aspects, two or more of (a) the reflective sheet or coating 406, (b) the reflector 410, (c) the reflective end panels 412 and (d) the reflective panel 414 may be combined together as a single piece of reflective material.

Figure 5:
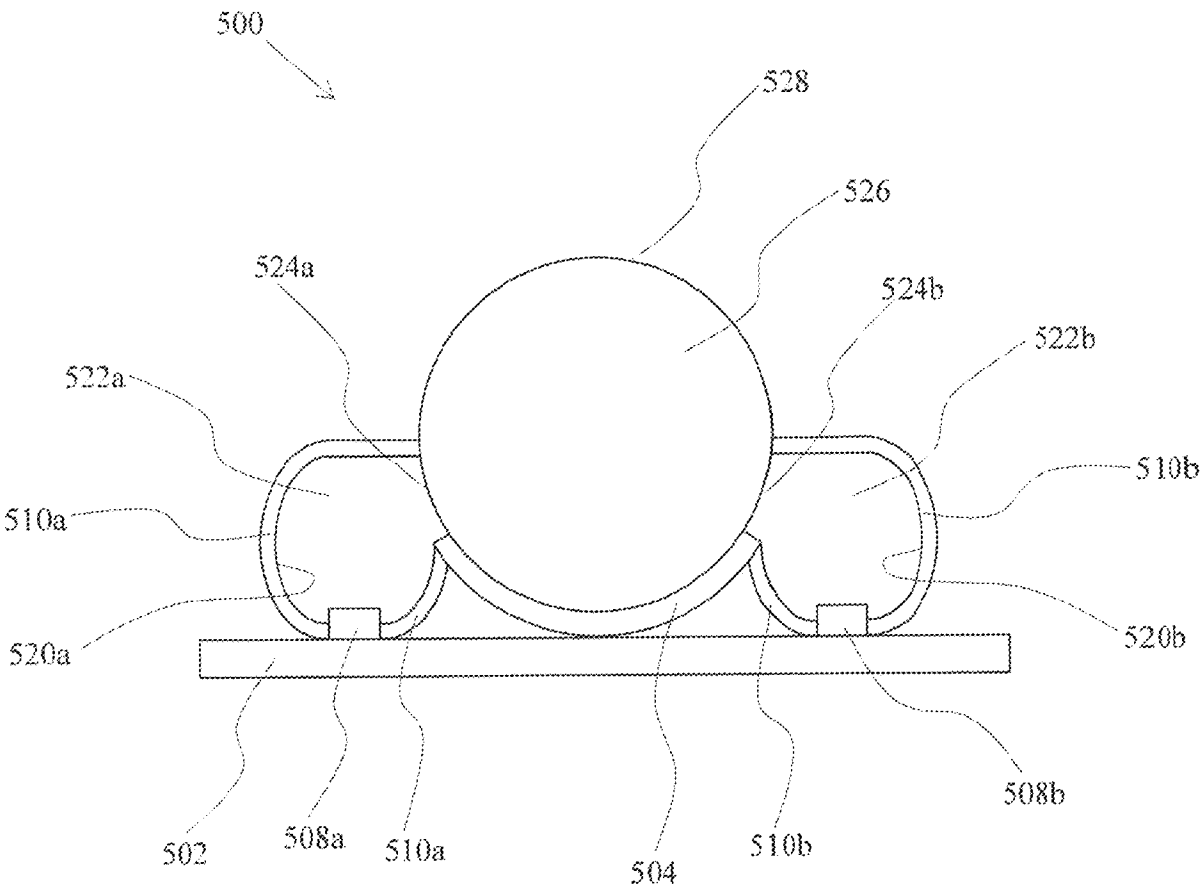
FIG. 5 illustrates yet other aspects of a luminaire.

FIG. 5 illustrates a cross-section of another luminaire 500 according to various aspects. The luminaire 500 is similar to the luminaire 300 but is different. The luminaire 500 includes a substrate 502, a reflector 504, a first plurality of light emitting diodes 508*a* and a second plurality of light emitting diodes 508*b*, a first reflector 510*a* and a second reflector 510*b*, reflective end panels 512 (not shown) and a geometric solid 526. According to various aspects, the luminaire 500 may also include a reflective sheet or coating 506 (not shown) and first and second reflective panels 514*a*, 514*b* (not shown).

The substrate 502, the reflector 504, the light emitting diodes 508*a*, 508*b*, the reflectors 510*a*, 510*b*, the reflective end panels 512 and the geometric solid 526 may be similar to or identical to the substrate 102, the reflector 104, the light emitting diodes 108, the reflector 110, the reflective end panels 112 and the geometric solid 426 described hereinabove. For aspects which include the reflective sheet or coating and the first and second reflective panels, these components may be similar to the reflective sheet of coating 106 and the reflective panel 114 described hereinabove.

The geometric solid 526 is made of a transparent material such as, for example, a plastic material or a glass material. The reflector 504 is connected to, coated on or adhered to a portion of an "exterior" surface 528 of the geometric solid 526, and includes a reflective material. Although the geometric solid 526 is shown in FIG. 5 as having a circular cross-section, it will be appreciated that according to other aspects, the geometric solid 526 can have a cross-section other than circular (e.g., any of the cross-sections described hereinabove with regard to the geometric solid 426 of FIG. 4). Additionally, although the geometric solid 526 has a uniform curvature, according to other aspects, the "exterior" surface 528 of the geometric solid 526 can include a compound curvature or have planar facets.

The first and second reflectors 510*a*, 510*b* are similar to the reflector 110, but the first reflector 510*a* includes curved surfaces 520*a* to the "left" and the "right" of the first plurality of light emitting diodes 508*a*, and the second reflector 510*b* includes curved surfaces 520*b* to the "left" and the "right" of the first plurality of light emitting diodes 508*a*. The first reflector 510*a* and the reflective end panels 512 cooperate to define the first reflective cavity 522*a*, and the second reflector 510*b* and the reflective end panels 512 cooperate to define the second reflective cavity 522*b*. For aspects where the luminaire 500 includes the reflective sheet or coating 506 and the reflective panels 514*a*, 514*b*, the first reflective cavity 522*a* may be formed by the combination of the reflective sheet or coating 506, the reflector 510*a*, the reflective end panels 512 and the reflective panel 514*a*. Similarly, for such aspects, the second reflective cavity 522*b* may be formed by the combination of the reflective sheet or coating 506, the reflector 510*b*, the reflective end panels 512 and the reflective panel 514*b*.

Light emitted from the first and second plurality of diodes 508*a*, 508*b* is diffusely reflected from one or more surfaces of the reflective cavities 522*a*, 522*b* in a manner similar to that described hereinabove, and the scattered/reflected light uniformly illuminates respective portions of the "exterior" surface 528 of the geometric solid 526 which are located along the apertures 524*a*, 524*b*. Light passing through the apertures 524*a*, 524*b* passes into the geometric solid 526, then is reflected from reflector 504 out into the surrounding environment. The transparent material of the geometric solid 526 assists in directing the light onto the "interior" surface 518 of the reflector 504 by means of reflection from the "exterior" surface 528 of the geometric solid 526. This increases the energy efficiency of the luminaire 500 as compared to the luminaire 300 and helps to further increase the spatial uniformity of the output light.

According to various aspects, the reflective cavities 522*a*, 522*b* are filled with a transparent material, and the transparent material may be any suitable type of transparent material. For such aspects, the reflectors 510*a*, 510*b* and the reflective end panels 512 may be reflective coatings on the transparent cavity material, or reflective films adhered to the transparent cavity material.

The cross-sectional shape of the reflective cavities 522*a*, 522*b* can be adjusted by introducing more or less curvature in their walls (e.g., reflectors 510*a*, 510*b*) or otherwise changing the shape of the reflective cavities 522*a*, 522*b* so as to optimize the uniformity of light output through the apertures 524*a*, 524*b*. In addition, the curvature and extent of the curvature of the reflector 504, its orientation relative to the apertures 524*a*, 524*b*, the "width" of the apertures 524*a*, 524*b* and the position and orientation of the apertures 524*a*, 524*b* relative to reflector 504 may all be varied so as to optimize the uniformity of light output by the reflector 504 and the light's angular distribution. According to other aspects, further tuning of the spatial uniformity of the light output can be realized by varying the cross-sectional shape of the reflective cavity 522*a* along its longitudinal axis (e.g., the axis containing the centers of the light emitting diodes 508*a* positioned within the reflective cavity 522*a*) and by varying the cross-sectional shape of the reflective cavity 522*b* along its longitudinal axis (e.g., the axis containing the centers of the light emitting diodes 508*b* positioned within the reflective cavity 522*b*).

According to various aspects, the reflectors 510*a*, 510*b* and the reflective end panels 512 may be combined together as a single piece of reflective material.

Figure 6:
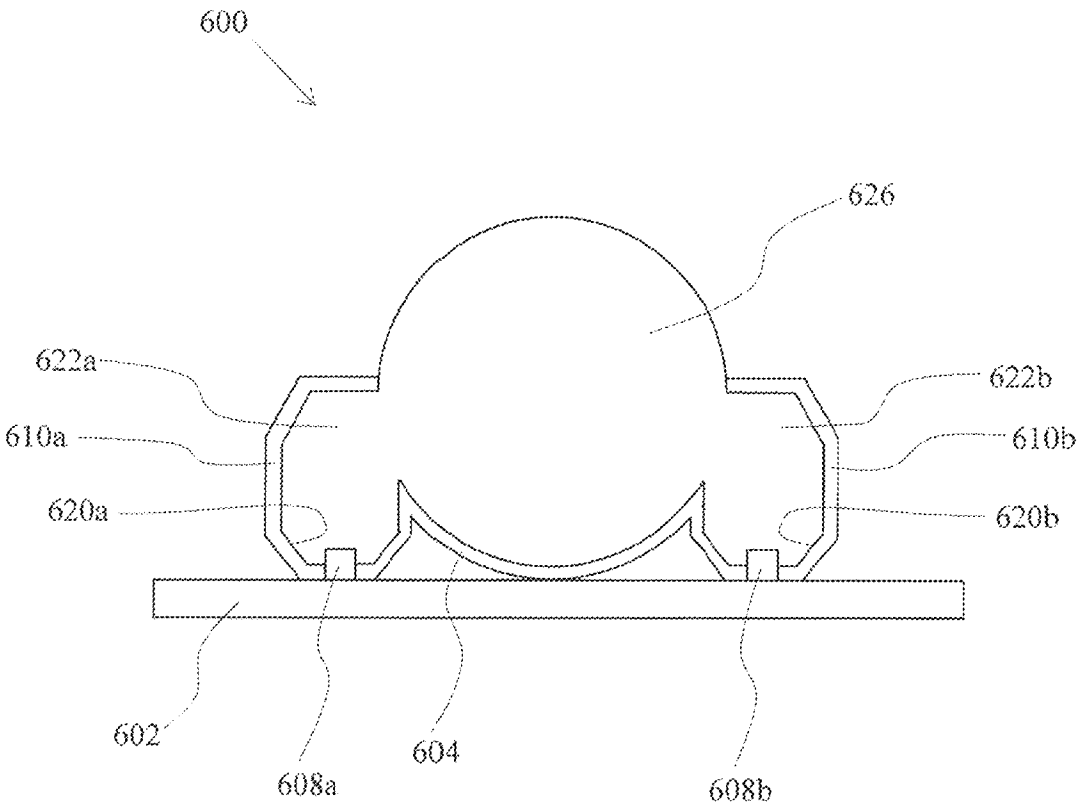
FIG. 6 illustrates yet other aspects of a luminaire.

FIG. 6 illustrates a cross-section of another luminaire 600 according to various aspects. The luminaire 600 is similar to the luminaire 500 in both arrangement and optical functionality, but is different. The luminaire 600 includes a substrate 602, a reflector 604, a first plurality of light emitting diodes 608*a* and a second plurality of light emitting diodes 608*b*, a first reflector 610*a* and a second reflector 610*b*, reflective end panels 612 (not shown) and a geometric solid 626. According to various aspects, the luminaire 600 may also include a reflective sheet or coating 606 (not shown) and first and second reflective panels 614*a*, 614*b* (not shown).

The substrate 602, the reflector 604, the light emitting diodes 608*a*, 608*b*, the reflectors 610*a*, 610*b*, the reflective end panels 612 and the geometric solid 626 may be similar to or identical to the substrate 102, the reflector 104, the light emitting diodes 108, the reflector 110, the reflective end panels 112 and the geometric solid 426 described hereinabove.

As shown in FIG. 6, in contrast to the curved portions 520*a*, 520*b* of the first and second reflectors 510*a*, 510*b*, the first and second reflectors 610*a*, 610*b* include a number of linear segments 620*a*, 620*b*. The linear segments 620*a* of the first reflector 610*a* collectively define a first reflective cavity 622*a* which has an octagonal or octagon-like cross-section, and the linear segments 620*b* of the second reflector 610*b* collectively define a second reflective cavity 622*b* which has an octagonal or octagonal-like cross-section. Of course, according to other aspects, the linear segments can define reflective cavities 622*a*, 622*b* which have cross-sections other than octagon or octagon-like.

Also, for the aspects shown in FIG. 6, the first and second reflective cavities 622*a*, 622*b* and the geometric solid 626 are extruded, molded or cast from a single piece of transparent material such as, for example, a transparent plastic.

Figure 7:
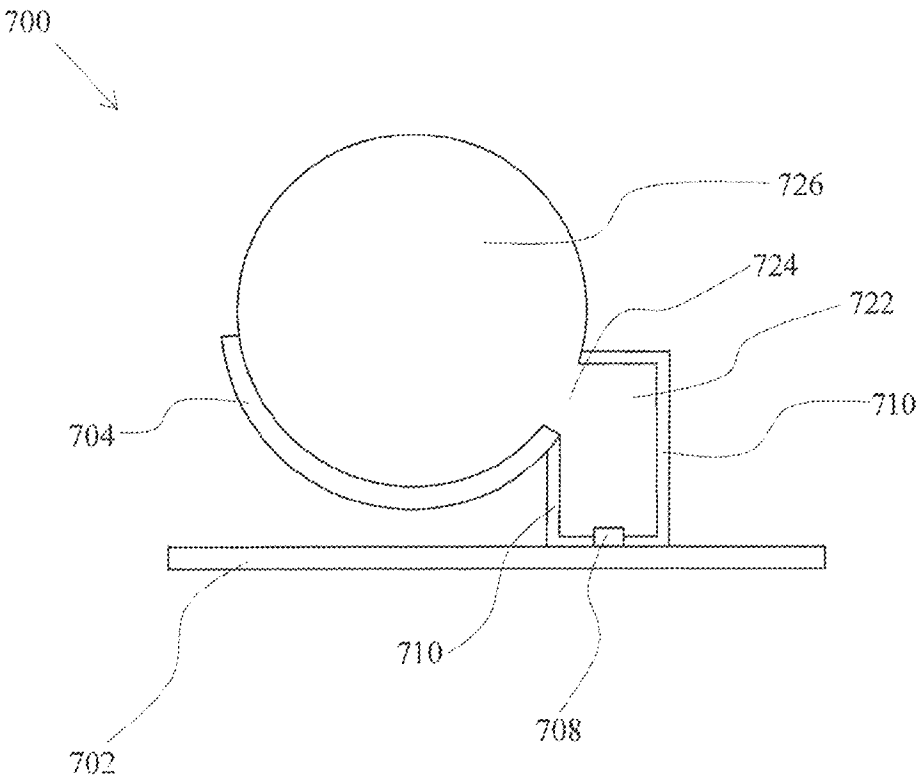
FIG. 7 illustrates yet other aspects of a luminaire.

FIG. 7 illustrates a cross-section of another luminaire 700 according to various aspects. The luminaire is similar to the luminaire 400, but is different. The luminaire 700 includes a substrate 702, a reflector 704, a plurality of light emitting diodes 708 (only one of which is shown), a reflector 710, reflective end panels 712 (not shown) and a geometric solid 726.

The substrate 702, the reflector 704, the plurality of light emitting diodes 708, the reflector 710, the reflective end panels 712 and the geometric solid 726 may be similar to or identical to the substrate 102, the reflector 104, the light emitting diodes 108, the reflector 110, the reflective end panels 112 and the geometric solid 426 described hereinabove.

According to various aspects, the reflector 704 includes the same diffuse reflective material that the reflector 710 includes. According to other aspects, the reflector 710 may be a diffuse reflective coating and the reflector 704 may have different reflective properties. For the aspects shown in FIG. 7, the reflective cavity 722 is filled with a transparent material, and the geometric solid 726 and the transparent material of the reflective cavity 722 can be formed from a single piece of extruded, molded or cast transparent material. The reflective cavity 722 is surrounded by the reflector 710 and the reflective end panels 712 (not shown). The reflector 710 and the reflective end panels 712 may be formed as a continuous diffuse reflective coating. Although the reflector 710 is shown as a single reflector 710, it will be appreciated that according to other aspects, the reflector 710 may be formed from multiple segments (e.g., one for each "wall" of the reflective cavity 722).

The cross-sectional shape of the reflective cavity 722 can be adjusted by introducing curvature in its walls (e.g., reflector 710) or otherwise changing the shape of the reflective cavity 722 so as to optimize the uniformity of light output through the aperture 724. In addition, the curvature and extent of the curvature of the reflector 704, its orientation relative to the aperture 724, the "width" of the aperture 724, and the position and orientation of the aperture 724 relative to reflector 704 may all be varied so as to optimize the uniformity of light output by the reflector 704 and the light's angular distribution. According to other aspects, further tuning of the spatial uniformity of the light output can be realized by varying the cross-sectional shape of the reflective cavity 722 along its longitudinal axis (e.g., the axis containing the centers of the light emitting diodes 708 positioned within the reflective cavity 722). As shown in FIG. 7, the reflector 704 does not need to be in contact with the substrate 702. In certain instances, the spatial relationship of the reflector 704 with the aperture 724 is better optimized by this arrangement.

Figure 8:
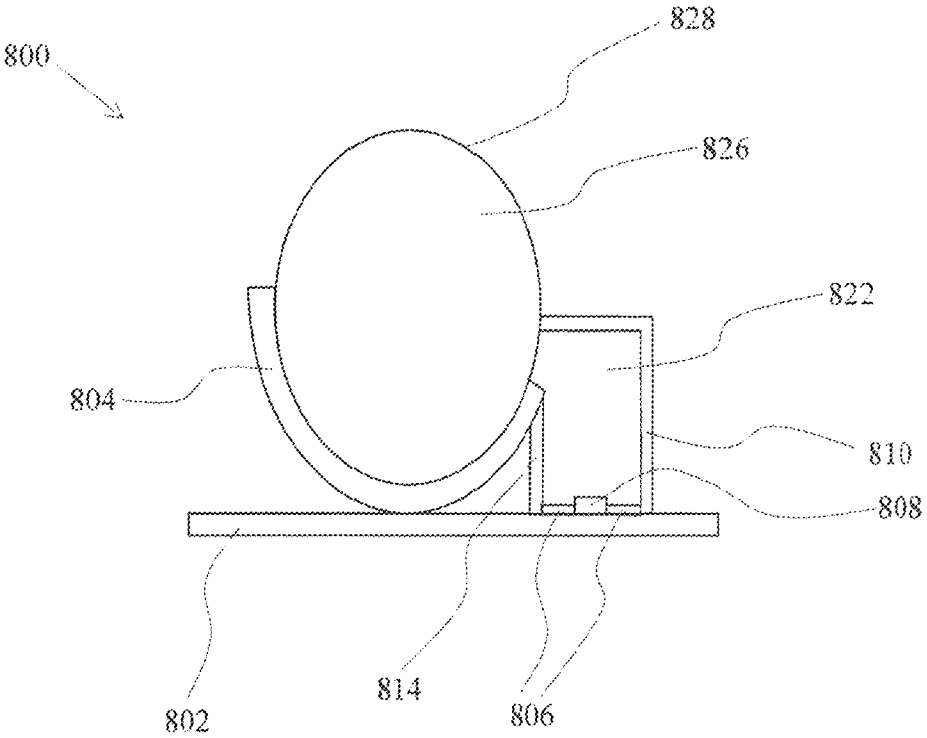
FIG. 8 illustrates yet other aspects of a luminaire.

FIG. 8 illustrates a cross-section of another luminaire 800 according to various aspects. The luminaire 800 is similar to the luminaire 400 in both arrangement and optical functionality, but is different. The luminaire 800 includes a substrate 802, a reflector 804, a reflective sheet or coating 806, a plurality of light emitting diodes 808 (only one of which is shown), a reflector 810, reflective end panels 812 (not shown) and a geometric solid 826. According to various aspects, the luminaire 800 may also include a reflective panel 814 as shown in FIG. 8.

The substrate 802, the reflector 804, the reflective sheet or coating 806, the plurality of light emitting diodes 808, the reflector 810, the reflective end panels 812 and the geometric solid 826 may be similar to or identical to the substrate 102, the reflector 104, the reflective sheet or coating 106, the light emitting diodes 108, the reflector 110, the reflective end panels 112 and the geometric solid 426 described hereinabove.

The geometric solid 826 is made of a transparent material such as, for example, a plastic material or a glass material. The reflector 804 is connected to, coated on or adhered to a portion of an "exterior" surface 828 of the cylinder 826, and includes a reflective material. In contrast to the geometric solid 426, the geometric solid 826 has an elliptical cross-section. Although the geometric solid 826 is shown in FIG. 8 as having an elliptical cross-section, it will be appreciated that according to other aspects, the geometric solid 826 can have a cross-section other than elliptical (e.g., any of the cross-sections described hereinabove with regard to the geometric solid 426 of FIG. 4).

Figure 9:
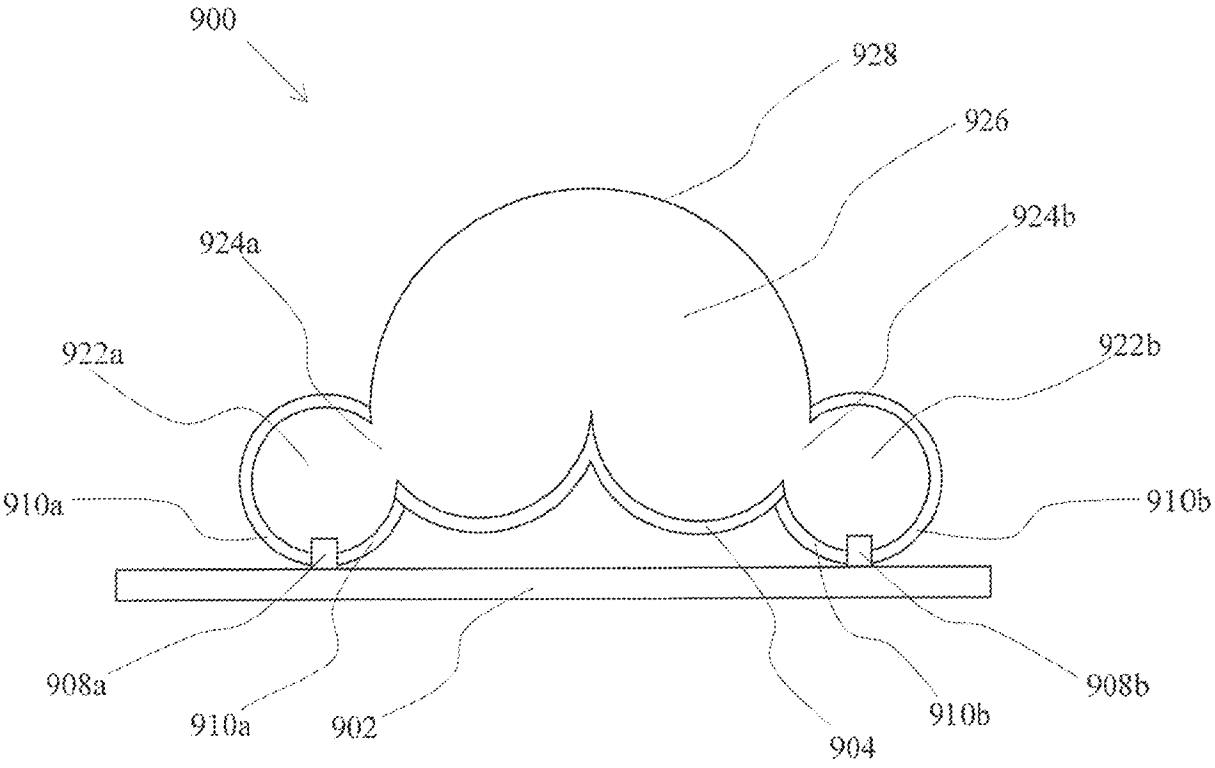
FIG. 9 illustrates yet other aspects of a luminaire.

FIG. 9 illustrates a cross-section of another luminaire 900 according to various aspects. The luminaire 900 includes a substrate 902, a reflector 904 with a compound curvature, a first plurality of light emitting diodes 908*a*, a second plurality of light emitting diodes 908*b*, a first reflector 910*a*, a second reflector 910*b*, reflective end panels 912 (not shown) and a geometric solid 926 having a compound curvature.

The substrate 902, the reflector 904, the light emitting diodes 908*a*, 908*b*, the reflectors 910*a*, 910*b*, the reflective end panels 912 and the geometric solid 926 may be similar to or identical to the substrate 102, the reflector 104, the light emitting diodes 108, the reflector 110, the reflective end panels 112 and the geometric solid 426 described hereinabove.

As shown in FIG. 9, the reflectors 910*a*, 910*b* are uniformly curved and substantially circular in cross-section, the geometric solid 926 has a cardioid or cardioid-like cross-section, and the reflector 904 has a cross-section consisting of a segment of the surface of a cardioid or cardioid-like solid. Although the geometric solid 926 is shown in FIG. 9 as having a cardioid or cardioid-like cross-section, it will be appreciated that according to other aspects, the geometric solid 826 can have a cross-section other than cardioid or cardioid-like (e.g., any of the cross-sections described hereinabove with regard to the geometric solid 426 of FIG. 4). According to various aspects, the reflector 904 is a reflective coating formed on a desired portion of the "exterior" surface 928 of the geometric solid 926. The reflector 904 resembles two reflectors with circular cross-sections side-by-side. According to various aspects, the reflector 904 includes the same diffuse reflective material that the reflectors 910*a*, 910*b* include. According to other aspects, the reflectors 910*a*, 910*b* may be diffuse reflective coatings and the reflector 904 may have different reflective properties.

Light emitted from the first and second plurality of diodes 908*a*, 908*b* is diffusely reflected from one or more surfaces of the reflective cavities 922*a*, 922*b* in a manner similar to that described hereinabove, and the scattered/reflected light which exits the reflective cavities 922*a*, 922*b* is spatially uniform in intensity. The light passing through the apertures 924*a*, 924*b* passes into the geometric solid 926, is reflected from the transparent walls (e.g., the "exterior" surface 928) of the geometric solid 926 to the reflector 904, then is reflected from reflector 904 out into the surrounding environment.

For the aspects shown in FIG. 9, the reflective cavities 922*a*, 922*b* are filled with a transparent material, and the geometric solid 926 and the transparent material of the reflective cavities 922*a*, 922*b* can be formed from a single piece of extruded, molded or cast transparent material. The reflective cavity 922*a* is surrounded by the reflector 910*a* and the reflective end panels 912, and the reflective cavity 922*b* is surrounded by the reflector 910*b* and the reflective end panels 914. The reflectors 910*a*, 910*b* and the reflective end panels 912 may be formed as a continuous diffuse reflective coating.

The cross-sectional shape of the reflective cavities 922*a*, 922*b* can be adjusted by introducing more or less curvature in their walls or otherwise changing the shape of the reflective cavities 922*a*, 922*b* so as to optimize the uniformity of light output through the apertures 924*a*, 924*b*. In addition, the curvature and extent of the curvature of the reflector 904, its orientation relative to the apertures 924*a*, 924*b*, the "width" of the apertures 924*a*, 924*b*, and the position and orientation of the apertures 924*a*, 924*b* relative to reflector 904 may all be varied so as to optimize the uniformity of light output by the reflector 904 and the light's angular distribution. According to other aspects, further tuning of the spatial uniformity of the light output can be realized by varying the cross-sectional shape of the reflective cavity 922*a* along its longitudinal axis (e.g., the axis containing the centers of the light emitting diodes 908*a* positioned within the reflective cavity 922*a*) and by varying the cross-sectional shape of the reflective cavity 922*b* along its longitudinal axis (e.g., the axis containing the centers of the light emitting diodes 908*b* positioned within the reflective cavity 922*b*).

Figure 10:
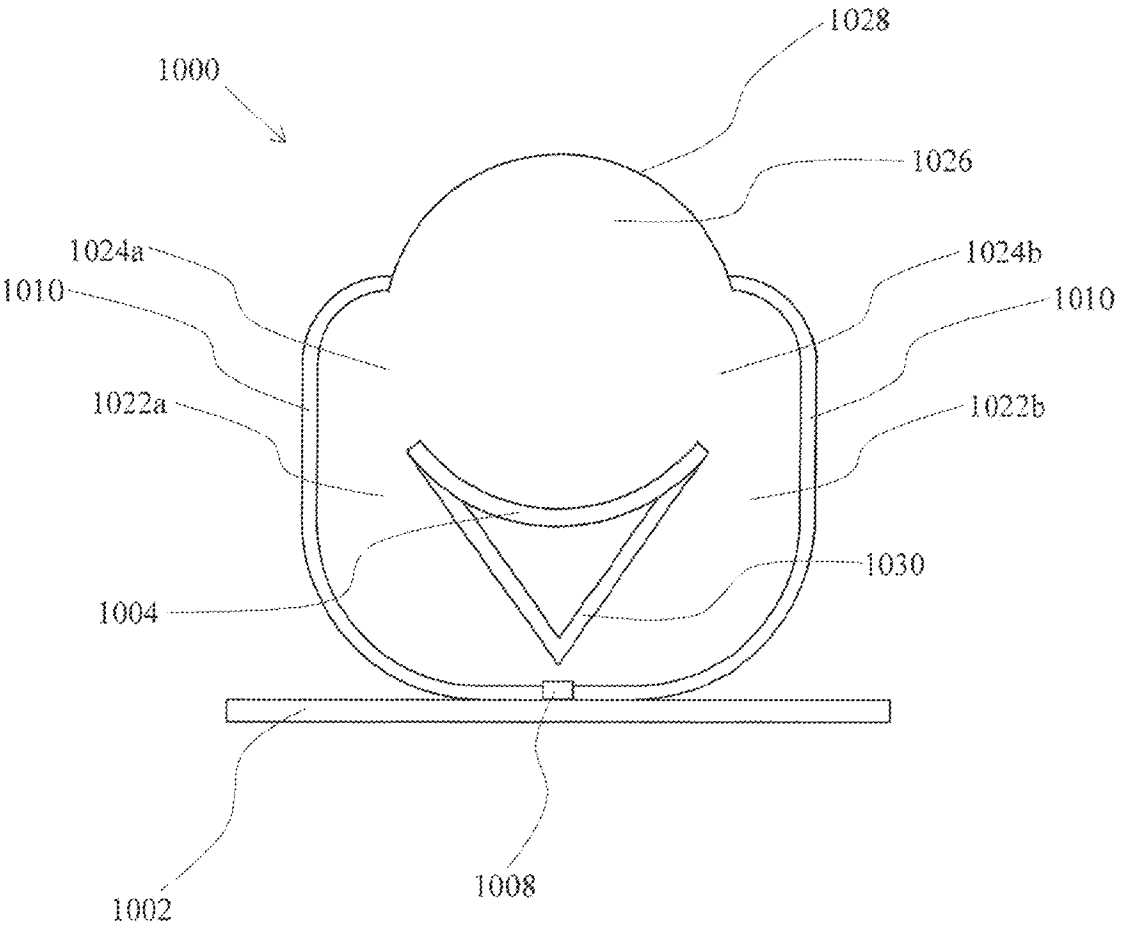
FIG. 10 illustrates yet other aspects of a luminaire.

FIG. 10 illustrates a cross-section of another luminaire 1000 according to various aspects. The luminaire 1000 includes a substrate 1002, a reflector 1004, a plurality of light emitting diodes 1008 (only one of which is shown), a reflector 1010, reflective end panels 1012 (not shown), a geometric solid 1026 and V-shaped reflector 1030.

The substrate 1002, the reflector 1004, the light emitting diodes 1008, the reflector 1010, the reflective end panels 1012 and the geometric solid 1026 may be similar to or identical to the substrate 102, the reflector 104, the light emitting diodes 108, the reflector 110, the reflective end panels 112 and the cylinder 426 described hereinabove.

The reflector 1010 is a diffuse reflector, and surrounds the geometric solid 1026, extending from the "left" of the geometric solid 1026 to the "right" of the geometric solid 1026. According to various aspects, the reflector 1004 includes the same diffuse reflective material that the reflector 1010 includes. According to other aspects, the reflector 1010 may be a diffuse reflective coating and the reflector 1004 may have different reflective properties.

The reflector 1010, the reflective end panels 1012 and the V-shaped reflector 1030 collectively cooperate to form the reflective cavity 1022. For the aspects shown in FIG. 10, the reflective cavity 1022 is filled with a transparent material, and the geometric solid 1026 and the transparent material of the reflective cavity 1022 can be formed from a single piece of extruded, molded or cast transparent material. The V-shaped reflector 1030 may be considered as dividing the reflective cavity 1022 into two substantially identical portions 1022*a*, 1022*b*.

The plurality of light emitting diodes 1008 are "aligned" in a single row similar to the arrangement shown in FIG. 1B. The light emitted from each of the light emitting diodes 1008 is split in two by the V-shaped reflector 1030, redirecting the light into the reflective cavities 1022*a*, 1022*b*. The redirected light is scattered from the diffusely reflective wall of the cavities 1022*a*, 1022*b* in such a way that light exiting the cavities 1022*a*, 1022*b* through apertures 1024*a*, 1024*b* is spatially uniform in intensity. The light passing through the apertures 1024*a*, 1024*b* passes into the geometric solid 1026, is reflected from the transparent walls (e.g., "exterior" surface 1028) of the geometric solid 1026 to the reflector 1004, then is reflected from reflector 1004 out into the surrounding environment.

The cross-sectional shape of the reflective cavities 1022*a*, 1022*b* can be adjusted by introducing more or less curvature in their walls (e.g., reflector 1010) or otherwise changing the shape of the reflective cavities 1022*a*, 1022*b* so as to optimize the uniformity of light output through the apertures 1024*a*, 1024*b*. In addition, the curvature and extent of the curvature of the reflector 1004, its orientation relative to the apertures 1024*a*, 1024*b*, the "width" of the apertures 1024*a*, 1024*b*, and the position and orientation of the apertures 1024*a*, 1024*b* relative to reflector 1004 may all be varied so as to optimize the uniformity of light output by the reflector 1004 and the light's angular distribution. According to other aspects, further tuning of the spatial uniformity of the light output can be realized by varying the cross-sectional shape of the reflective cavity 1022 along its longitudinal axis (e.g., the axis containing the centers of the light emitting diodes 1008 positioned within the reflective cavity 1022).

Figure 11:
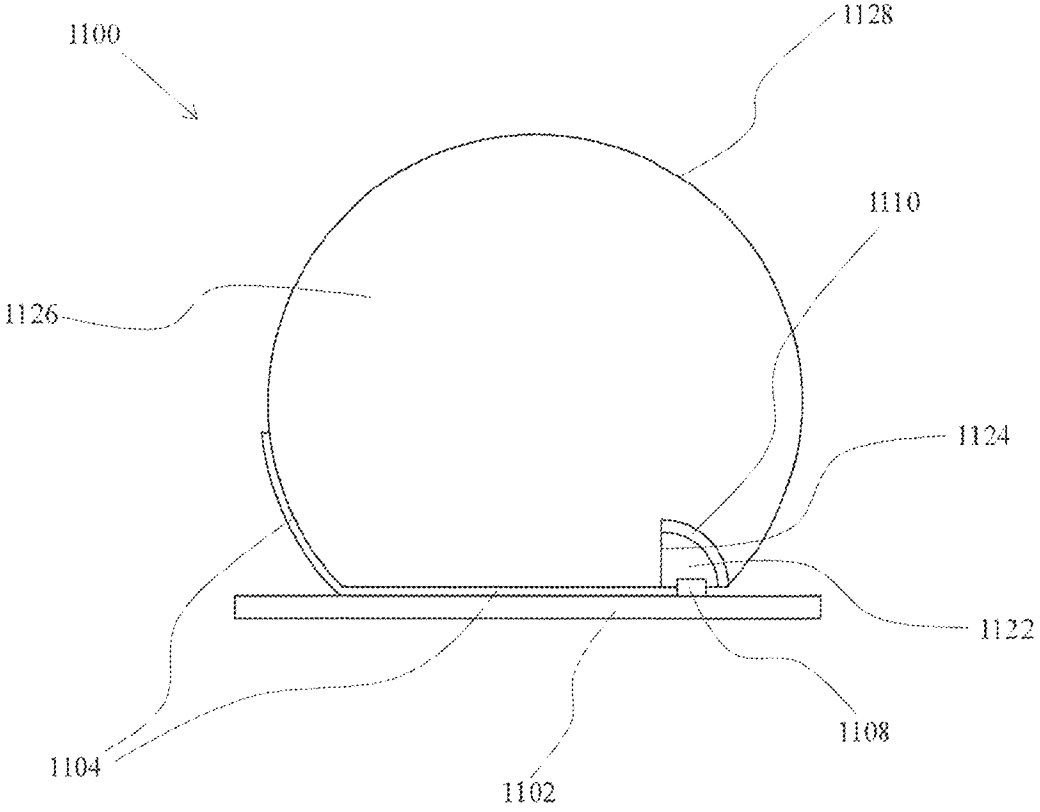
FIG. 11 illustrates yet other aspects of a luminaire.

FIG. 11 illustrates various aspects of another luminaire 1100. The luminaire 1100 includes a substrate 1102, a reflector 1104, a plurality of light emitting diodes 1108 (only one of which is shown), a reflector 1110, reflective end panels 1112 (not shown) and a geometric solid 1126.

The substrate 1102, the reflector 1104, the light emitting diodes 1108, the reflector 1110, the reflective end panels 1112 and the geometric solid 1126 may be similar to or identical to the substrate 102, the reflector 104, the light emitting diodes 108, the reflector 110, the reflective end panels 112 and the geometric solid 426 described hereinabove.

As shown in FIG. 11, in contrast to the geometric solid 426, the geometric solid 1126 includes a faceted surface and defines a small reflective cavity 1122 which is an inclusion into the geometric solid 1126. Although the geometric solid 1126 is shown in FIG. 11 as having a faceted circular-like cross-section, it will be appreciated that according to other aspects, the geometric solid 1126 can have a cross-section other than a faceted circular-like (e.g., any of the cross-sections described hereinabove with regard to the geometric solid 426 of FIG. 4). The reflector 1104 is connected to, coated on or adhered to a curved portion and a faceted portion of the "exterior" surface 1128 of the geometric solid 1126. For the aspects shown in FIG. 11, the reflector 1110 may be a diffuse reflector or a specular reflector and may be considered a wall of the reflective cavity 1122. The reflective cavity 1122 may include air or be filled with a transparent material. According to various aspects, the geometric solid 1126 can be extruded, molded or cast from a transparent material.

The light emitting diodes 1108 emit light into the reflective cavity 1122. The light from the light emitting diodes 1108 is specularly or diffusely reflected from the reflector 1110. The light then exits the reflective cavity 1122 through the aperture 1124 into the geometric solid 1126. The light passing through the aperture 1124 passes into the geometric solid 1126, is reflected from the transparent walls (e.g., the "exterior" surface 1128) of the geometric solid 1126 to the reflector 1104, then is reflected from reflector 1104 out into the surrounding environment.

The cross-sectional shape of the reflective cavity 1122 may be adjusted by introducing more or less curvature in its walls (e.g., reflector 1110) or otherwise changing the cavity shape so as to optimize the uniformity of light output through the aperture 1124. In addition the curvature and the extent of the curvature of the reflector 1104, its orientation relative to the aperture 1124, the "width" of aperture 1124, and the position and orientation of the aperture 1124 relative to the reflector 1104 may all be varied so as to optimize the uniformity of light output by reflector 1104 and its and the light's angular distribution. According to other aspects, further tuning of the spatial uniformity of the light output can be realized by varying the cross-sectional shape of the reflective cavity 1122 along its longitudinal axis (e.g., the axis containing the centers of the light emitting diodes 1108 positioned within the reflective cavity 1122).

Figure 12:
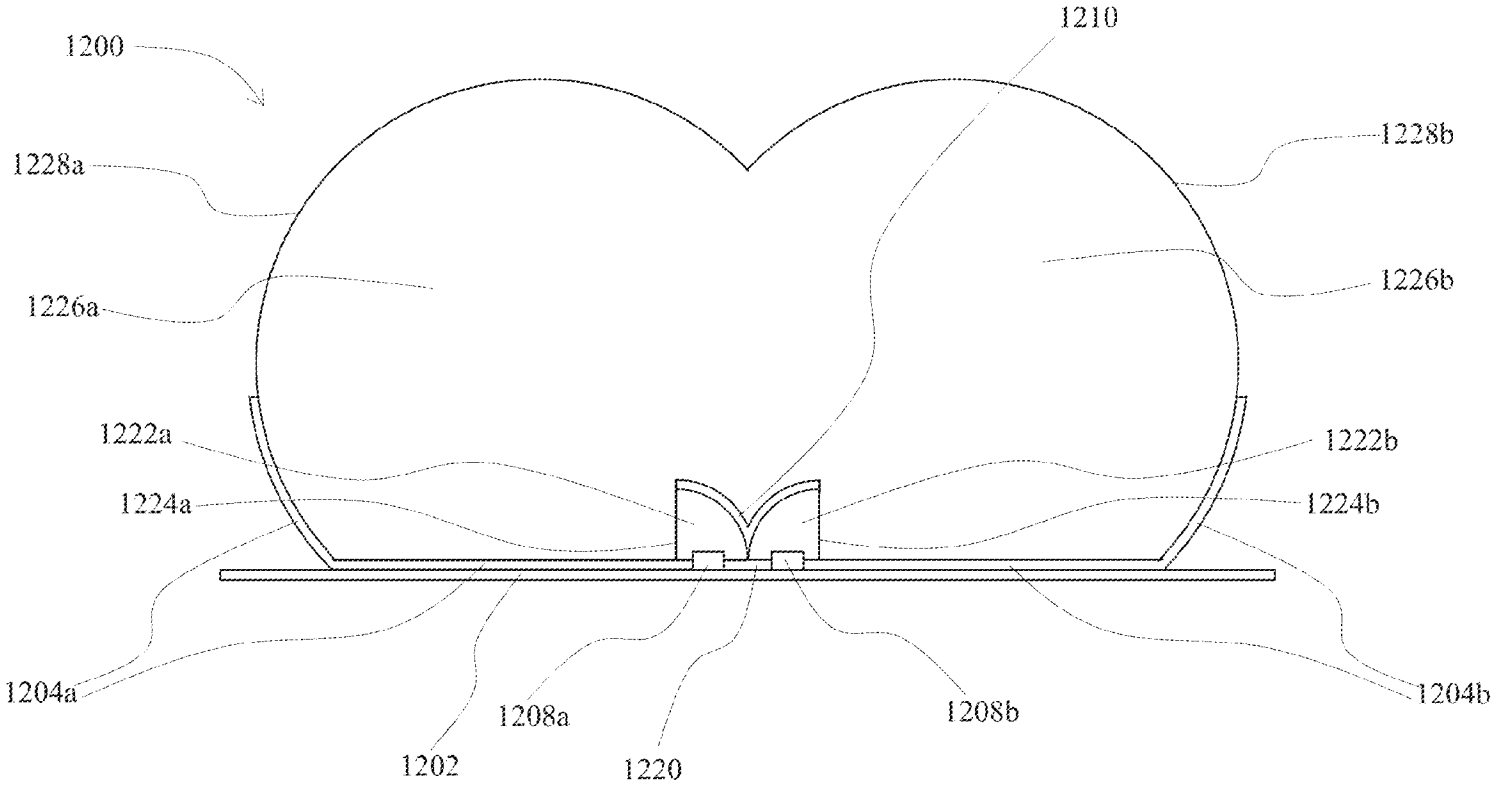
FIG. 12 illustrates yet other aspects of a luminaire.

FIG. 12 illustrates a cross-section of another luminaire 1200 according to various aspects. The luminaire 1200 includes a substrate 1202, a first diffuse reflector 1204*a*, a second diffuse reflector 1204*b*, a first plurality of light emitting diodes 1208*a* (only one of which is shown), a second plurality of light emitting diodes 1208*b* (only one of which is shown), a reflector 1210, reflective end panels 1212 (not shown), a reflector 1220, a first geometric solid portion 1226*a* and a second geometric solid portion 1226*b*.

The substrate 1202, the diffuse reflectors 1204*a*, 1204*b*, the light emitting diodes 1208*a*, 1208*b*, the reflector 1210, the reflective end panels 1212 and the geometric solid portions 1226*a*, 1226*b* may be similar or identical to the substrate 1102, the reflector 1104, the light emitting diodes 1108, the reflector 1110, the reflective end panels 1112 and the geometric solid 1126 described hereinabove. According to various aspects, the reflector 1220 can form part of a single reflective sheet which includes the diffuse reflectors 1204*a*, 1204*b*. According to other aspects, the reflector 1220 is separate and distinct from the diffuse reflectors 1204*a*, 1204*b*. Thus, it will be appreciated that the reflector 1220 can be diffuse, specular or a combination of the two.

As shown in FIG. 12, the geometric solid portions 1226*a*, 1226*b* have a faceted circular-like cross-section and are joined together side-by-side such that the geometric solids 1226*a*, 1226*b* are conjoined into a single geometric solid which comprises a transparent material and defines a longitudinal axis (not shown) of the luminaire 1200. The cross-section of the geometric solid portion 1226*a* is substantially a mirror-image of the cross-section of the geometric solid portion 1226*b*. Although the geometric solid portions 1226*a*, 1226*b* are shown in FIG. 12 as having faceted circular-like cross-sections, it will be appreciated that according to other aspects, the geometric solid portions 1226*a*, 1226*b* can have cross-sections other than faceted circular-like cross-sections (e.g., any of the cross-sections described hereinabove with regard to the geometric solid 426 of FIG. 4). The first geometric solid portion 1226*a* defines a small reflective cavity 1222*a* which is an inclusion into the geometric solid 1226*a*. The reflector 1204*a* is connected to, coated on or adhered to a curved portion and a faceted portion of the "exterior" surface 1228*a* of the geometric solid 1226*a*. Similarly, the second geometric solid portion 1226*b* defines a small reflective cavity 1222*b* which is an inclusion into the geometric solid portion 1226*b* and the reflector 1204*b* is connected to, coated on or adhered to a curved portion and a faceted portion of the "exterior" surface 1228*b* of the geometric solid portion 1226*b*. For the aspects shown in FIG. 12, the reflector 1210 may be a diffuse reflector or a specular reflector and may be considered a wall of the reflective cavities 1222*a* and/or 1222*b*. The reflective cavities 1222*a* and 1222*b* may include air or be filled with another transparent material. According to various aspects, the geometric solid portions 1226*a*, 1226*b* can be extruded, molded or cast from a transparent material.

The light emitting diodes 1208*a* emit light into the reflective cavity 1222*a* and the light emitting diodes 1208*b* emit light into the reflective cavity 1222*b*. The light from the light emitting diodes 1208*a*, 1208*b* may be specularly or diffusely reflected from the reflector 1210. The light then exits the reflective cavities 1222*a*, 1222*b* through the respective apertures 1224*a*, 1224*b* into the respective geometric solid portions 1226*a*, 1226*b*. The light passing through the apertures 1224*a*, 1224*b* and into the geometric solid portions 1226*a*, 1226*b* may be reflected from the transparent walls (e.g., the "exterior" surfaces 1228*a*,1228*b*) of the geometric solid portions 1226*a*, 1226*b* to the reflectors 1204*a*, 1204*b*, then may be reflected from reflectors 1204*a*, 1204*b* out into the surrounding environment.

The cross-sectional shape of the reflective cavities 1222*a*, 1222*b* may be adjusted by introducing more or less curvature in their walls (e.g., reflector 1210) or otherwise changing the cavity shape so as to optimize the uniformity of light output through the apertures 1224*a*, 1224*b*. In addition the curvature and the extent of the curvature of the reflectors 1204*a*, 1204*b*, their orientation relative to the apertures 1224*a*, 1224*b*, the "width" of apertures 1224*a*, 1224*b*, and the position and orientation of the apertures 1224*a*, 1224*b* relative to the reflectors 1204*a*, 1204*b* may all be varied so as to optimize the uniformity of light output by reflectors 1204*a*, 1204*b* and its and the light's angular distribution. According to other aspects, further tuning of the spatial uniformity of the light output can be realized by varying the cross-sectional shape of the reflective cavities 1222*a*, 1222*b* along their longitudinal axes (e.g., the axes containing the centers of the light emitting diodes 1208*a*, 1208*b* positioned within the reflective cavities 1222*a*, 1222*b*).

Figure 13:
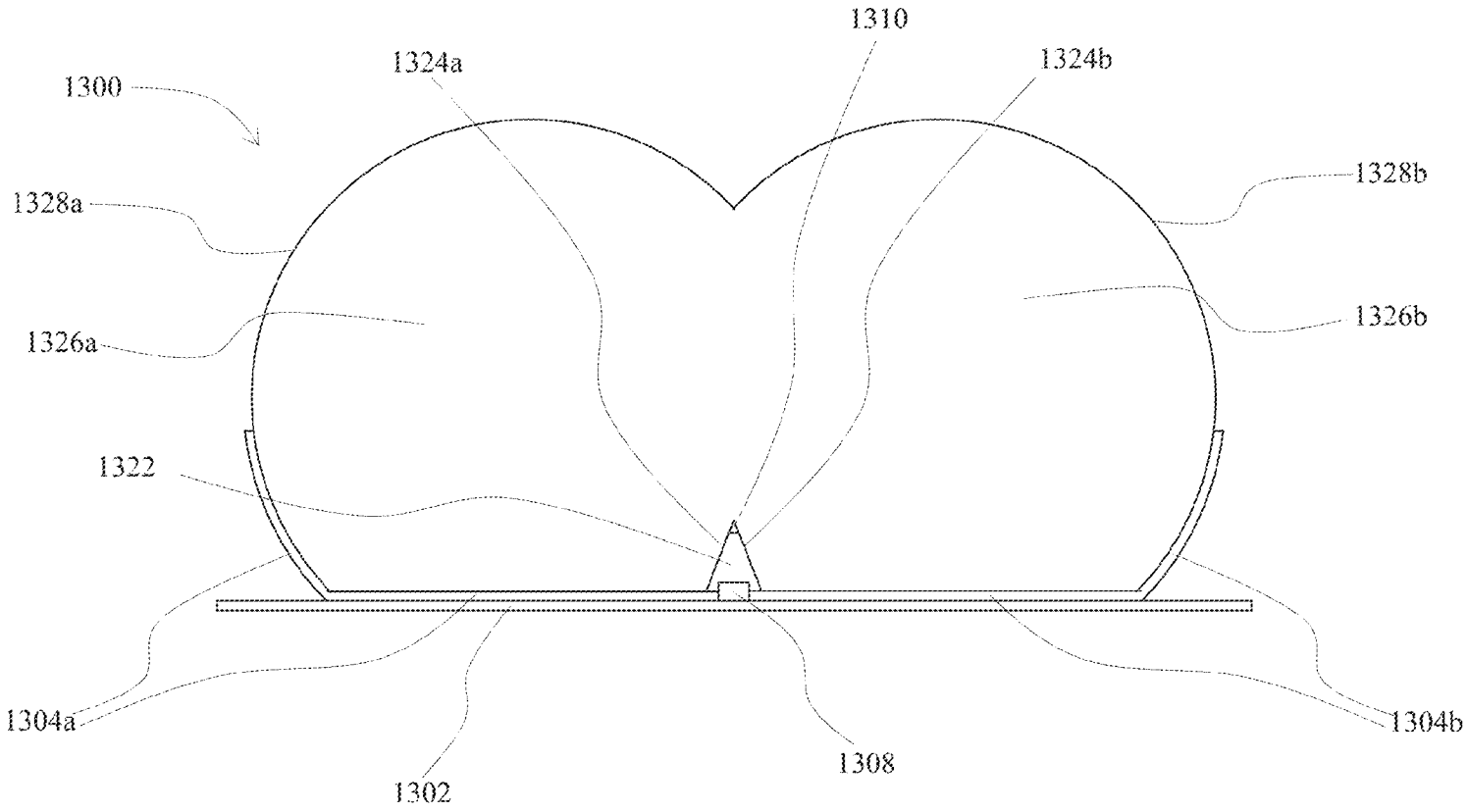
FIG. 13 illustrates yet other aspects of a luminaire.

FIG. 13 illustrates a cross-section of another luminaire 1300 according to various aspects. The luminaire 1300 includes a substrate 1302, a first diffuse reflector 1304*a*, a second diffuse reflector 1304*b*, a plurality of light emitting diodes 1308 (only one of which is shown), reflective end panels 1312 (not shown), a first geometric solid portion 1326*a* and a second geometric solid portion 1326*b*.

The substrate 1302, the diffuse reflectors 1304*a*, 1304*b*, the light emitting diodes 1308, the reflective end panels 1312 and the geometric solid portions 1326*a*, 1326*b* may be similar or identical to the substrate 1102, the reflector 1104, the light emitting diodes 1108, the reflective end panels 1112 and the geometric solid portions 1226*a*, 1226*b* described hereinabove. The luminaire 1300 is similar to the luminaire 1200 but is different in that the luminaire 1300 includes only a single cavity 1322.

As shown in FIG. 13, the geometric solid portions 1326*a*, 1326*b* have faceted circular-like cross-sections which are joined together side-by-side such that the geometric solid portions 1326*a*, 1326*b* are conjoined into a single geometric solid which comprises a transparent material and defines a longitudinal axis (not shown) of the luminaire 1300. The cross-section of the geometric solid portion 1326*a* is substantially a mirror-image of the cross-section of the geometric solid portion 1326*b*. Although the geometric solid portions 1326*a*, 1326*b* are shown in FIG. 13 as having faceted circular-like cross-sections, it will be appreciated that according to other aspects, the geometric solid portions 1326*a*, 1326*b* can have cross-sections other than faceted circular-like cross-sections (e.g., any of the cross-sections described hereinabove with regard to the geometric solid 426 of FIG. 4). The geometric solid portions 1326*a*, 1326*b* collectively define the cavity 1322 which is an inclusion into the geometric solid portions 1326*a*, 1326*b*. The cavity 1322 is shown in FIG. 13 as having the cross-section of a triangular prism. A triangular prism includes a "bottom" face, two "side" faces and two "end" faces.

According to various aspects, the luminaire 1300 may further include a reflector 1310 positioned within the cavity 1322 (shown at the "top" or apex of the cavity 1322 in FIG. 13. The reflector 1310 may be a diffuse reflector or a specular reflector, may be considered as one or more surfaces, faces or walls of the cavity 1322 and may be similar or identical to the reflector 1210. For example, the reflector 1310 may form a "top" surface of the cavity 1322, a "left" side surface of the cavity 1322 and/or a "right" side surface of the cavity 1322. The reflector 1304*a* is connected to, coated on or adhered to a curved portion and a faceted portion of the "exterior" surface 1328*a* of the geometric solid portion 1326*a* and the reflector 1304*b* is connected to, coated on or adhered to a curved portion and a faceted portion of the "exterior" surface 1328*b* of the geometric solid portion 1326*b*. For the aspects shown in FIG. 13, the cavity 1322 may include air or be filled with another transparent material. According to various aspects, the geometric solid portions 1326*a*, 1326*b* can be extruded, molded or cast from a transparent material.

The light emitting diodes 1308 emit light into the cavity 1322. Some of the light emitted from the light emitting diodes 1308 encounters an interface (a refractive index boundary) between the air in the cavity 1322 and the transparent solid material comprising the geometric solid portions 1326*a*, 1326*b*. This material interface occurs at aperture 1324*a* between the cavity 1322 and the geometric solid portion 1326*a*. Depending on the angle at which this portion of light impinges on the interface at the aperture 1324*a*, some this light may enter the geometric solid portion 1326*a*. However, a considerable portion of the light will be reflected back into the cavity 1322 and may exit through the aperture 1324*b*. Similarly, a portion of the light emitted from the light emitting diodes 1308 encounters the material interface at the aperture 1324*b*. Some of this light may be transmitted through the interface at the aperture 1324*b* into the geometric solid portion 1326*b* or it may be reflected back into the cavity 1322 thence exiting through the aperture 1324*a* into the geometric solid portion 1326*a*. It will be appreciated that the two "side" surfaces/faces of the cavity 1322 function both as apertures 1324*a*, 1324*b* to transmit light into the geometric solid portions 1326*a* and 1326*b*, and also function in a manner similar to the reflector 1210 in the luminaire 1200 to reflect light out through the apertures 1324*a*, 1324*b*. It will also be appreciated that the great majority of light produced by the light emitting diodes 1308 will either be transmitted through the apertures 1324*a*, 1324*b* immediately or be recycled one or more times from the "side" surfaces/faces of the cavity 1322 finally exiting through the apertures 1324*a*, 1324*b*.

After the light emitted by the light emitting diodes 1308 passes through the apertures 1324*a*, 1324*b*, the light may transverse the geometric solid portions 1326*a*, 1326*b* and enter the surrounding environment or it may be specularly or diffusely reflected from the reflectors 1304*a*, 1304*b* and enter the surrounding environment. As shown in FIG. 13, the reflectors 1304*a*, 1304*b* may extend under the cavity 1322 so as to re-reflect light reflected from the "side" surfaces/faces of the cavity 1322 at apertures 1324*a*, 1324*b*. For aspects which include the reflector 1310, the reflector 1310 may help to eliminate a discernable "hot spot" when an observer stares straight "down" into the luminaire 1300 towards the light emitting diodes 1308 from directly "above".

The cross-sectional shape of the cavity 1322 may be adjusted by introducing curvature or more curvature in its walls (e.g., reflector 1310) or otherwise changing the shape of the cavity 1322 so as to optimize the uniformity of light output through the apertures 1324*a*, 1324*b*. In addition, the curvature and the extent of the curvature of the reflectors 1304*a*, 1304*b*, their orientation relative to the apertures 1324*a*, 1324*b*, the "width" of apertures 1324*a*, 1324*b*, and the position and orientation of the apertures 1324*a*, 1324*b* relative to the reflectors 1304*a*, 1304*b* may all be varied so as to optimize the uniformity of light output by reflectors 1304*a*, 1304*b* and its and the light's angular distribution. According to other aspects, further tuning of the spatial uniformity of the light output can be realized by varying the cross-sectional shape of the cavity 1322 along its longitudinal axis (e.g., the axis containing the centers of the light emitting diodes 1308 positioned within the cavity 1322). Thus, it will be appreciated the cross-section of the cavity 1322 may be other than the cross-section of a triangular prism.

According to various aspects, the two conjoined geometric solid portions 1326*a*, 1326*b* may be replaced by any suitable transparent solid shape with two conjoined solid portions that receive light from the apertures 1324*a*, 1324*b*.

Figure 14:
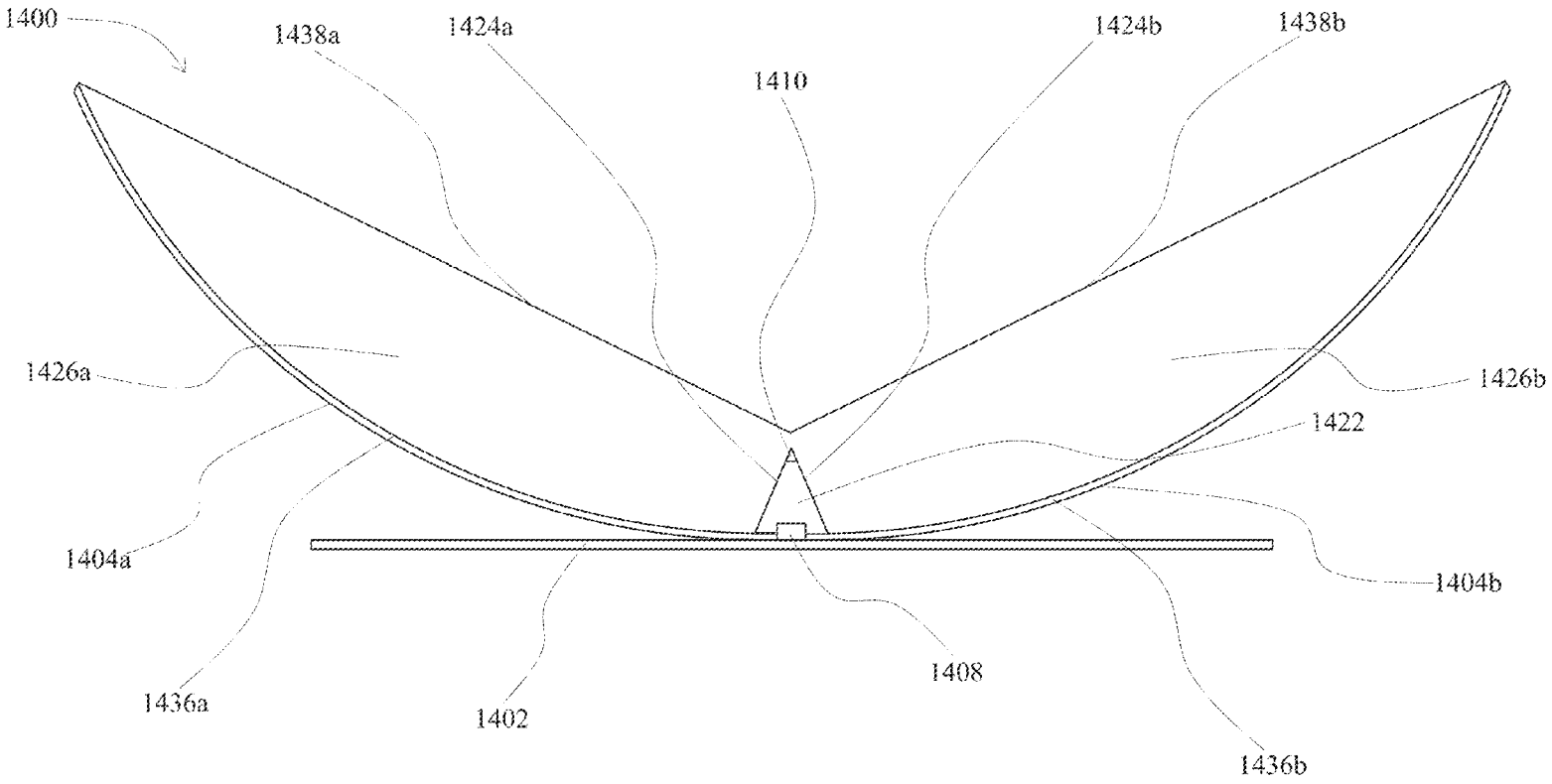
FIG. 14 illustrates yet other aspects of a luminaire.

FIG. 14 illustrates a cross-section of another luminaire 1400 according to various aspects. The luminaire 1400 includes a substrate 1402, a first diffuse reflector 1404*a*, a second diffuse reflector 1404*b*, a plurality of light emitting diodes 1408 (only one of which is shown), reflective end panels (not shown), a first geometric solid portion 1426*a* and a second geometric solid portion 1426*b*.

The substrate 1402, the diffuse reflectors 1404*a*, 1404*b*, the light emitting diodes 1408, the reflective end panels and the geometric solid portions 1426*a*, 1426*b* may be similar or identical to the substrate 1102, the reflector 1104, the light emitting diodes 1108, the reflective end panels 1112 and the geometric solid portions 1326*a*, 1326*b* described hereinabove.

As shown in FIG. 14, the geometric solid portions 1426*a*, 1426*b* have lobe or lobe-like cross-sections bounded by curved surfaces 1436*a*, 1436*b* and planar surfaces 1438*a*, 1438*b*. The lobe or lobe-like cross-sections are joined together side-by-side and are conjoined into a single geometric solid which comprises a transparent material and defines a longitudinal axis (not shown) of the luminaire 1400. The cross-section of the geometric solid portion 1426*a* is substantially a mirror-image of the cross-section of the geometric solid portion 1426*b*. Although the geometric solid portions 1426*a*, 1426*b* are shown in FIG. 14 as having lobe or lobe-like cross-sections, it will be appreciated that according to other aspects, the geometric solid portions 1426*a*, 1426*b* can have cross-sections other than lobe or lobe-like cross-sections (e.g., any of the cross-sections described hereinabove with regard to the geometric solid 426 of FIG. 4).

According to other aspects, in lieu of the curved surfaces 1436*a*, 1436*b* shown in FIG. 14, the geometric solid portions 1426*a*, 1426*b* may include other curved surfaces. For example, the geometric solid portions 1426*a*, 1426*b* may include curved surfaces whose cross-sections are segments of conic sections such as circles, ellipses, parabolas, hyperbolas, etc. According to other aspects, the geometric solid portions 1426*a*, 1426*b* may include surfaces with compound curvatures. According to other aspects, the geometric solid portions 1426*a*, 1426*b* may include other curved surfaces in lieu of or in addition to the planar surfaces 1438*a*, 1438*b*. For example, according to various aspects, the planar surfaces 1438*a*, 1438*b* may be replaced with curved surfaces, the planar surfaces 1438*a*, 1438*b* may be replaced with planar-like surfaces having a Fresnel lens formed therein, the planar surfaces 1438*a*, 1438*b* may be replaced with planar-like surfaces having a prismatic array formed therein, etc. Thus, it will be appreciated that the geometric solid portions 1426*a*, 1426*b* may be bound by more than two curved or planar surfaces.

The geometric solid portions 1426*a*, 1426*b* collectively define a cavity 1422 which is an inclusion into the geometric solid portions 1426*a*, 1426*b*. The cavity 1422 may be similar or identical to the cavity 1322 described hereinabove. According to various aspects, the luminaire 1400 may further include a reflector 1410 positioned within the cavity 1422 (shown at the "top" or apex of the cavity 1422 in FIG. 14). The reflector 1410 may be a diffuse reflector or a specular reflector, may be considered as one or more surfaces, faces or walls of the cavity 1422 and may be similar or identical to the reflector 1310. The reflector 1404*a* is connected to, coated on or adhered to the curved portion 1436*a* of the geometric solid 1426*a* and the reflector 1404*b* is connected to, coated on or adhered to a curved portion 1436*b* of the geometric solid 1426*b*. For the aspects shown in FIG. 14, the cavity 1422 may include air or be filled with another transparent material. According to various aspects, the conjoined geometric solid portions 1426*a*, 1426*b* can be extruded, molded or cast from a transparent material.

The light emitting diodes 1408 emit light into the cavity 1422. The emitted light traverses the air-filled cavity 1422, and in a manner similar to the light traversing the cavity 1322 of the luminaire 1300, is either transmitted or reflected by the material interfaces at the apertures 1424*a*, 1424*b*. Light is reflected and recirculated within the cavity 1422 in a manner analogous with the reflection and recirculation described hereinabove for the cavity 1322. Light exiting the apertures 1424*a*, 1424*b* may either pass through the geometric solid portions 1426*a*, 1426*b* and exit through surfaces 1408*a*, 1408*b* into the surrounding environment or it may be reflected from the diffuse reflectors 1404*a*, 1404*b* resulting in redirection out through the planar surfaces 1438*a*, 1438*b* into the surrounding environment. As shown in FIG. 14, the reflectors 1404*a*, 1404*b* may extend under the cavity 1422 so as to re-reflect light reflected from the cavity surfaces/faces/walls at the apertures 1424*a*, 1424*b*. For aspects which include the reflector 1410, the reflector 1410 may help to eliminate a discernable "hot spot" when an observer stares straight "down" into the luminaire 1400 towards the light emitting diodes 1408 from directly "above".

Figure 15:
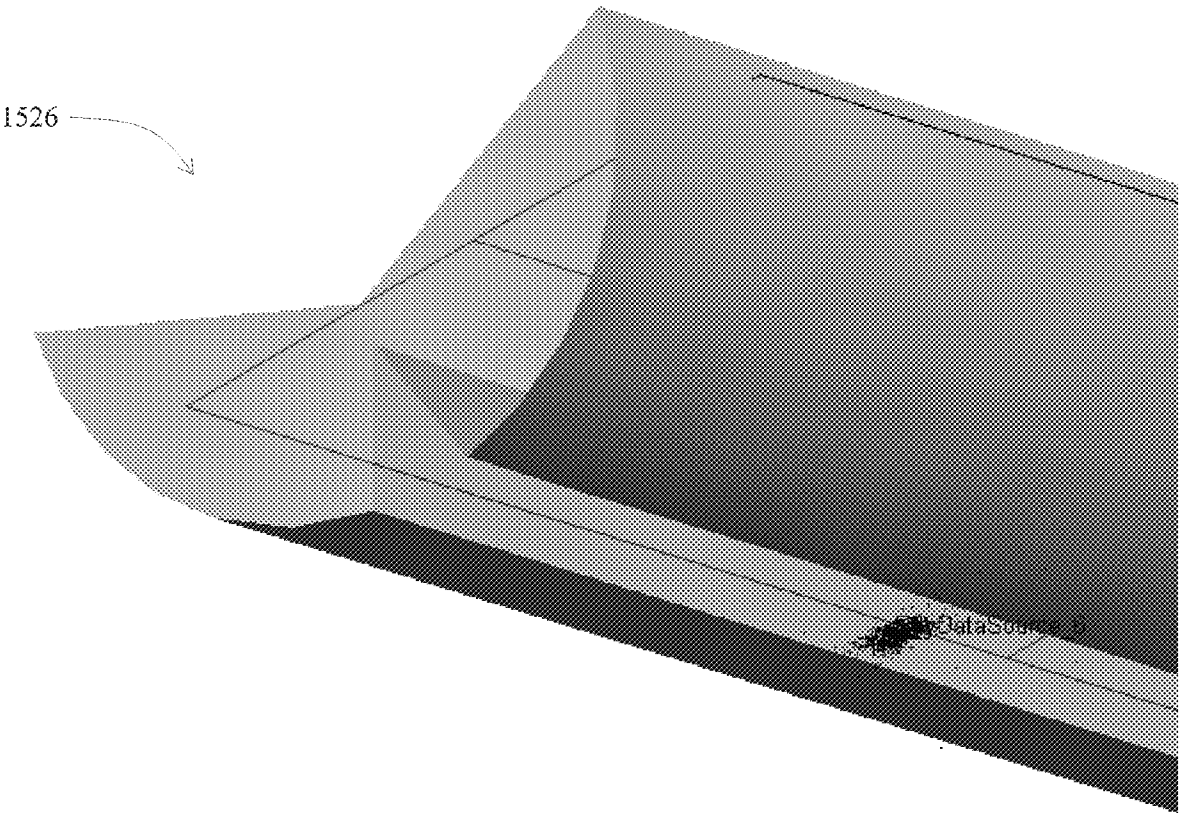
FIG. 15 illustrates a representation of a component of the luminaire of FIG. 14 according to various aspects.

FIG. 15 illustrates a representation of a component 1526 of the luminaire 1400 according to various aspects. The representation is a 3-D rendering of a transparent, solid component 1526 which is similar to or corresponds to the combination of the geometric solid portions 1426*a*, 1426*b*.

Figure 16:
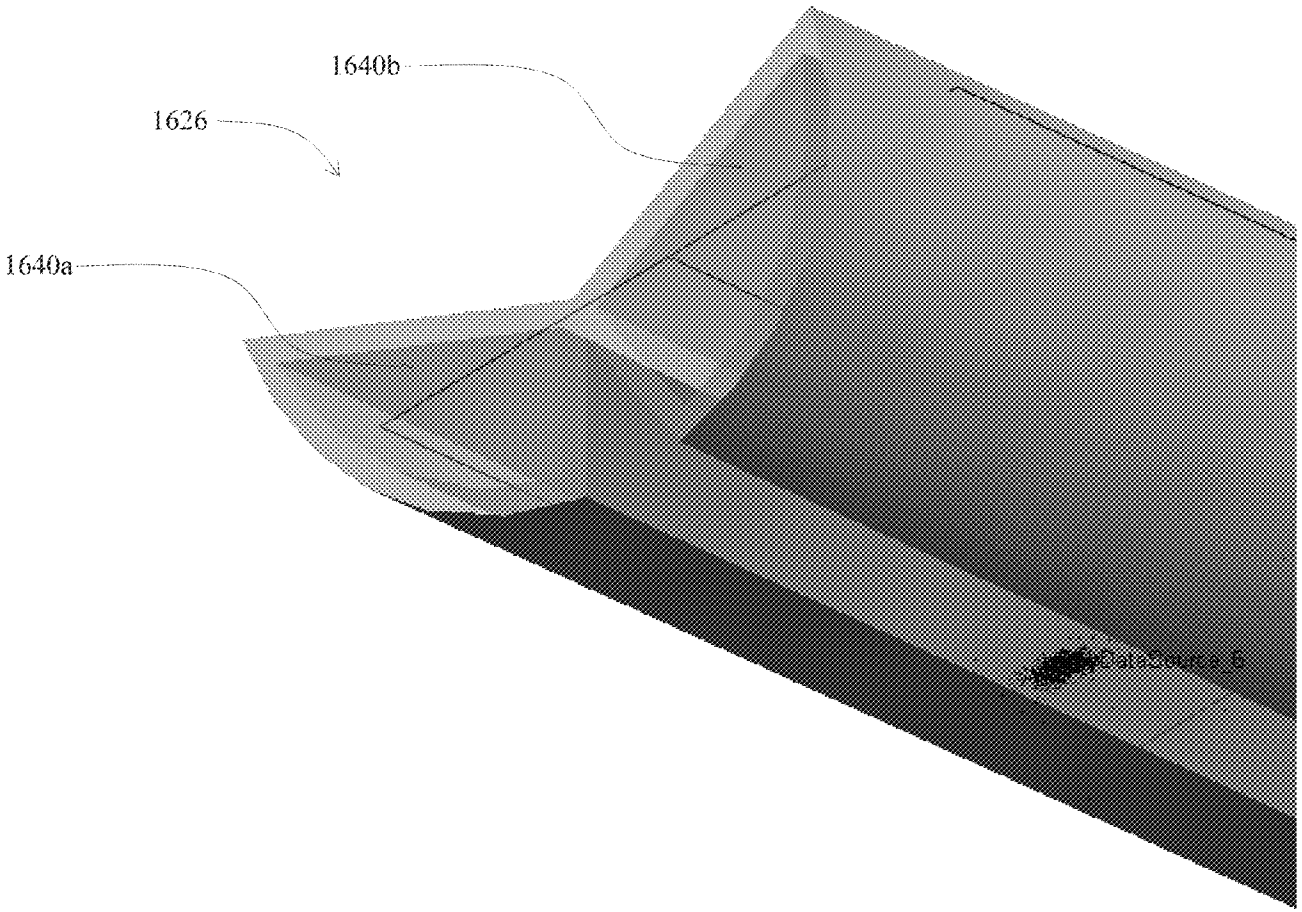
FIG. 16 illustrates a representation of a component of the luminaire of FIG. 14 according to other aspects.

FIG. 16 illustrates a representation of a component 1626 of the luminaire 1400 according to other aspects. The representation is a 3-D rendering of a transparent component 1626 which is similar to or corresponds to the combination of the geometric solid portions 1426*a*, 1426*b*. The component 1626 is different from the component 1526 in that the component 1626 includes air-filled cavities 1640*a*, 1640*b* in the respective centers of the "lobe portions" of the component 1626 corresponding to the geometric solid portion 1426*a* and 1426*b*. A component 1626 of this type may be advantageous due to reduced material usage and weight.

In the luminaires 400-1400 described hereinabove, light is injected from a cavity or cavities of some shape (e.g., the reflective cavity 422) into a geometric solid of transparent material (e.g., the cylinder 426). The light is then reflected from a final reflector (e.g., the reflector 404) into the surrounding environment. In these aspects, the final reflectors are connected to, coated onto or adhered to the geometric solid of transparent material. In some instances, for reasons such as manufacturing cost or convenience, it may be advantageous to have the final reflectors not be in direct contact with surfaces of the geometric solid, but rather be only proximate to them. That is to say they could be located on an adjacent mounting case or some other proximate surface.

Figure 17:
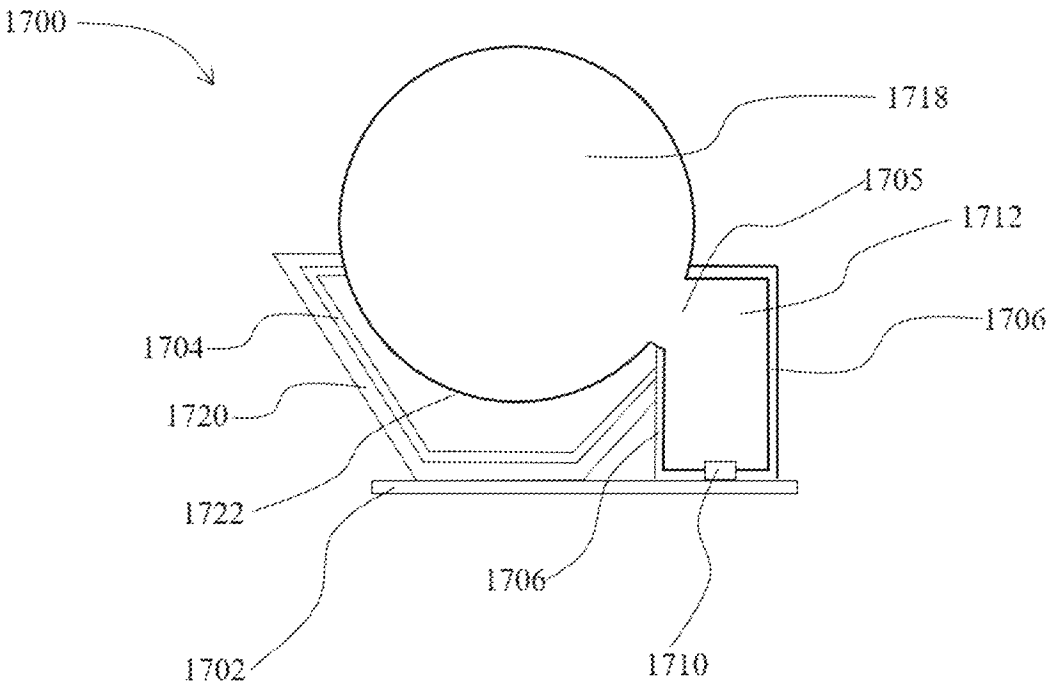
FIG. 17 illustrates yet other aspects of a luminaire.

FIG. 17 illustrates a cross-section of another luminaire 1700 according to various aspects. The luminaire 1700 is similar to the luminaire 700, but is different. The luminaire 1700 includes a substrate 1702, a reflector 1704, a plurality of light emitting diodes 1708 (only one of which is shown), a reflector 1710, reflective end panels (not shown) and a geometric solid 1726. For these aspects, the reflector 1704 is connected to, coated on or adhered to a surface of a mounting case 1728.

The substrate 1702, the reflector 1704, the plurality of light emitting diodes 1708, the reflector 1710, the reflective end panels and the geometric solid 1726 may be otherwise similar to or identical to the substrate 702, the reflector 704, the light emitting diodes 708, the reflector 710, the reflective end panels 712 and the geometric solid 726 described hereinabove.

According to various aspects, the reflector 1704 includes the same diffuse reflective material that the reflector 1710 includes. According to other aspects, the reflector 1710 may be a diffuse reflective coating and the reflector 1704 may have different reflective properties. For the aspects shown in FIG. 17, the reflective cavity 1722 is filled with a transparent material, and the geometric solid 1726 and the transparent material of the reflective cavity 1722 can be formed from a single piece of extruded, molded or cast transparent material. The reflective cavity 1722 is surrounded by the reflector 1710 and the reflective end panels (not shown). The reflector 1710 and the reflective end panels may be formed as a continuous diffuse reflective coating. Although the reflector 1710 is shown as a single reflector 1710, it will be appreciated that according to other aspects, the reflector 1710 may be formed from multiple segments (e.g., one for each "wall" of the reflective cavity 1722).

The cross-sectional shape of the reflective cavity 1722 can be adjusted by introducing curvature in its walls (e.g., reflector 1710) or otherwise changing the shape of the reflective cavity 1722 so as to optimize the uniformity of light output through the aperture 1724. In addition, the curvature and extent of the curvature of the reflector 1704, its orientation relative to the aperture 1724, the "width" of the aperture 1724, and the position and orientation of the aperture 1724 relative to reflector 1704 may all be varied so as to optimize the uniformity of light output by the reflector 1704 and the light's angular distribution. According to other aspects, further tuning of the spatial uniformity of the light output can be realized by varying the cross-sectional shape of the reflective cavity 1722 along its longitudinal axis (e.g., the axis containing the centers of the light emitting diodes 1708 positioned within the reflective cavity 1722). As shown in FIG. 17, the reflector 1704 does not need to be in contact with the substrate 1702. In certain instances, the spatial relationship of the reflector 1704 with the aperture 1724 is better optimized by this arrangement.

For the aspects shown in FIG. 17, light emanates from the reflective cavity 1722 through the aperture 1724 into the geometric solid 1726. However, rather than the light being reflected from a reflector (or reflectors) on an "exterior" surface 1730 of the geometric solid 1726, some light, whose direction of propagation is generally "downward" in FIG. 17, exits through the "exterior" surface 1730 of the geometric solid 1726 and then strikes the reflector 1704 connected to, coated on or adhered onto the "interior" surfaces of the mounting case 1728. The light is then directed back through the "exterior" surface 1730 into the geometric solid 1726 and subsequently into the outside environment.

The mounting case 1728 and the reflector 1704 are shown in FIG. 17 as having particular cross-sections. However, it will be appreciated that the cross-sectional shapes of the mounting case 1728 and the reflector 1704 may be adjusted or otherwise varied so as to optimize the performance of the luminaire 1700. Thus, it will be appreciated that the cross-sections of the mounting case 1728 and the reflector 1704 may be different from those shown in FIG. 17.

Figure 18:
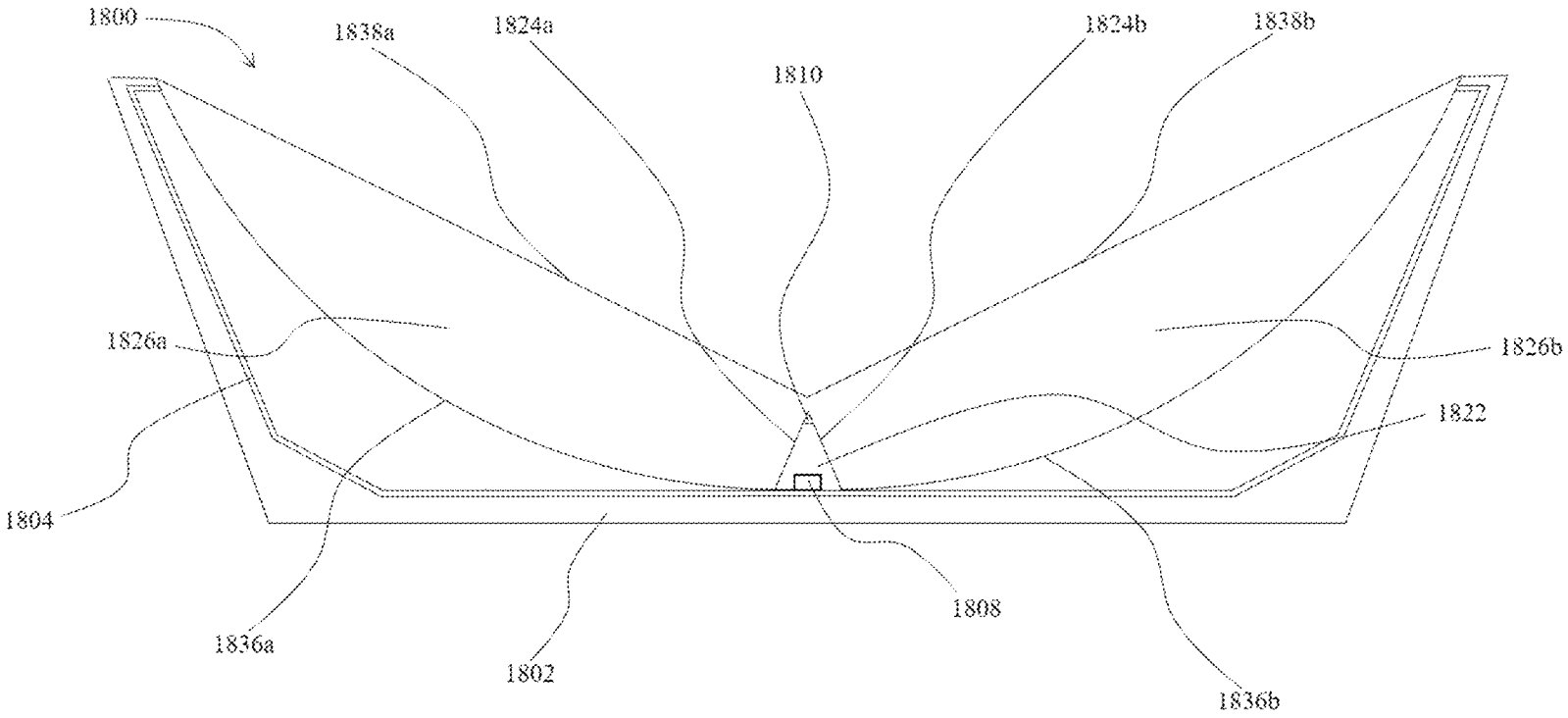
FIG. 18 illustrates yet other aspects of a luminaire.

FIG. 18 illustrates a cross-section of another luminaire 1800 according to various aspects. The luminaire 1800 is similar to the luminaire 1400, but is different. The luminaire 1800 includes a first diffuse reflector 1804*a*, a second diffuse reflector 1804*b*, a plurality of light emitting diodes 1808 (only one of which is shown), reflective end panels (not shown), a first geometric solid portion 1826*a* and a second geometric solid portion 1826*b*. For these aspects, the first and second diffuse reflectors 1804*a*, 1804*b* are connected to, coated on or adhered to a surface of a mounting case 1828. According to various aspects, the first and second diffuse reflectors 1804*a*, 1804*b* may be portions of the same diffuse reflector.

The diffuse reflectors 1804*a*, 1804*b*, the light emitting diodes 1808, the reflective end panels and the geometric solid portions 1826*a*, 1826*b* may be similar or identical to the diffuse reflectors 1404*a*, 1404*b*, the light emitting diodes 1408, the reflective end panels and the first and second geometric solid portions 1426*a*, 1426*b* described hereinabove.

As shown in FIG. 18, the geometric solid portions 1826*a*, 1826*b* are joined together side-by-side and are conjoined into a single geometric solid which comprises a transparent material and defines a longitudinal axis (not shown) of the luminaire 1800. The cross-section of the geometric solid portion 1826*a* is substantially a mirror-image of the cross-section of the geometric solid portion 1826*b*. The geometric solid portions 1826*a*, 1826*b* have lobe or lobe-like cross-sections bounded by curved surfaces 1836*a*, 1836*b* and planar surfaces 1838*a*, 1838*b*. Although the geometric solid portions 1826*a*, 1826*b* are shown in FIG. 18 as having lobe or lobe-like cross-sections, it will be appreciated that according to other aspects, the geometric solid portion 1826*a*, 1826*b* can have cross-sections other than lobe or lobe-like cross-sections (e.g., any of the cross-sections described hereinabove with regard to the geometric solid 426 of FIG. 4). According to various aspects, the conjoined geometric solid portions 1826*a*, 1826*b* can be extruded, molded or cast from a transparent material. According to various embodiments, the geometric solid portions 1826*a*, 1826*b* may also include air-filled cavities (not shown) similar to the air-filled cavities 1640*a*, 1640*b* shown in FIG. 16.

According to other aspects, in lieu of the curved surfaces 1836*a*, 1836*b* shown in FIG. 18, the geometric solid portions 1826*a*, 1826*b* may include other curved surfaces. For example, the geometric solid portions 1826*a*, 1826*b* may include curved surfaces whose cross-sections are segments of conic sections such as circles, ellipses, parabolas, hyperbolas, etc. According to other aspects, the geometric solid portions 1826*a*, 1826*b* may include surfaces with compound curvatures. According to other aspects, the geometric solid portions 1826*a*, 1826*b* may include other curved surfaces in lieu of or in addition to the planar surfaces 1838*a*, 1838*b*. For example, according to various aspects, the planar surfaces 1838*a*, 1838*b* may be replaced with curved surfaces, the planar surfaces 1838*a*, 1838*b* may be replaced with planar-like surfaces having a Fresnel lens formed therein, the planar surfaces 1838*a*, 1838*b* may be replaced with planar-like surfaces having a prismatic array formed therein, etc. Thus, it will be appreciated that the geometric solid portions 1826*a*, 1826*b* may be bound by more than two curved or planar surfaces.

The geometric solid portions 1826*a*, 1826*b* collectively define a cavity 1822 which is an inclusion into the geometric solid portions 1826*a*, 1826*b*. The cavity 1822 may be similar or identical to the cavity 1422 described hereinabove. The cavity 1822 may include air or be filled with another transparent material. According to various aspects, the luminaire 1800 may further include a reflector 1810 positioned within the cavity 1822 (shown at the "top" or apex of the cavity 1822 in FIG. 18). The reflector 1810 may be a diffuse reflector or a specular reflector, may be considered as one or more surfaces/faces/walls of the cavity 1822 and may be similar or identical to the reflector 1410.

For the aspects shown in FIG. 18, light emanates from the cavity 1822 through the apertures 1824*a*, 1824*b* and into the geometric solid portions 1826*a*, 1826*b*. However, rather than the light being reflected from a reflector (or reflectors) on the curved surfaces 1836*a*, 1836*b* of the geometric solid portions 1826*a*, 1826*b*, some light exits through the curved surfaces 1836*a*, 1836*b* and then strikes the diffuse reflectors 1804*a*, 1804*b* connected to, coated on or adhered onto the "interior" surfaces of the mounting case 1828. The light is then directed back through the curved surfaces 1836*a*, 1836*b* into the geometric solid portions 1826*a*, 1826*b* and subsequently into the outside environment.

The mounting case 1828 and the diffuse reflectors 1804*a*, 1804*b* are shown in FIG. 18 as having particular cross-sections. However, it will be appreciated that the cross-sectional shapes of the mounting case 1828 and the diffuse reflectors 1804*a*, 1804*b* may be adjusted or otherwise varied so as to optimize the performance of the luminaire 1800. Thus, it will be appreciated that the cross-sections of the mounting case 1828 and the diffuse reflectors 1804*a*, 1804*b* may be different from those shown in FIG. 18.

EXAMPLES

Example 1

A luminaire is provided. The luminaire comprises a geometric solid. The geometric solid has a length and comprises a first geometric solid portion which comprises an optically clear material and a second geometric solid portion which comprises the optically clear material, wherein the first and second geometric solid portions are conjoined. The luminaire further comprises a cavity defined by the first and second geometric solid portions, a plurality of discrete light sources positioned to emit light into the cavity, a first aperture positioned to allow a first portion of light in the cavity to pass into the first geometric solid portion, and a second aperture positioned to allow a second portion of the light in the cavity to pass into the second geometric solid portion.

Example 2

The luminaire of Example 1, wherein the first geometric solid portion comprises a first curved surface extending the length of the geometric solid and a first planar surface extending the length of the geometric solid, and wherein the second geometric solid portion comprises a second curved surface extending the length of the geometric solid and a second planar surface extending the length of the geometric solid, wherein a cross-section of the first geometric solid portion is a mirror image of a cross-section of the second geometric solid portion.

Example 3

The luminaire of Examples 1 or 2, wherein the first geometric solid portion has a first lobe-like cross section and the second geometric solid portion has a second lobe like cross-section, wherein the second lobe-like cross-section is a mirror image of the first lobe-like cross section.

Example 4

The luminaire of Examples 1, 2 or 3, wherein the cavity extends along the length of the geometric solid.

Example 5

The luminaire of Examples 1, 2, 3 or 4, wherein the cavity comprises air.

Example 6

The luminaire of Examples 1, 2, 3 or 4, wherein the cavity comprises another optically clear material.

Example 7

The luminaire of Examples 1, 2, 3, 4, 5 or 6, wherein at least one of the plurality of discrete light sources comprises a light emitting diode.

Example 8

The luminaire of Examples 1, 2, 3, 4, 5, 6 or 7, wherein the geometric solid defines a longitudinal axis and the plurality of discrete light sources are aligned with the longitudinal axis.

Example 9

The luminaire of Examples 1, 2, 3, 4, 5, 6 or 7, wherein the geometric solid defines a longitudinal axis and at least one of the plurality of discrete light sources is offset from the longitudinal axis.

Example 10

The luminaire of Examples 1, 2, 3, 5, 6, 7, 8 or 9, further comprising a reflective material positioned in the cavity.

Example 11

The luminaire of Example 10, wherein the reflective material defines at least one of a first surface of the cavity and a second surface of the cavity.

Example 12

The luminaire of Examples 1, 2, 3, 4, 5, 6, 7, 8, 9, 10 or 11, further comprising a reflector positioned to reflect light which exited from the geometric solid back into the geometric solid.

Example 13

The luminaire of Example 12, wherein the reflector is connected to a surface of the geometric solid.

Example 14

The luminaire of Example 12, wherein the reflector is external to the geometric solid.

Example 15

The luminaire of Examples 1, 2, 3, 4, 5, 6, 7, 8, 9, 10, 11, 12, 13 or 14, further comprising a first reflective surface positioned adjacent a first end of the geometric solid and a second reflective surface positioned adjacent a second end of the geometric solid.

Although the various aspects of the luminaires have been described herein in connection with certain disclosed aspects, many modifications and variations to those aspects may be implemented. Also, where materials are disclosed for certain components, other materials may be used. Furthermore, according to various embodiments, a single component may be replaced by multiple components, and multiple components may be replaced by a single component, to perform a given function or functions. The foregoing description and the appended claims are intended to cover all such modifications and variations as falling within the scope of the disclosed aspects.

While this invention has been described as having exemplary designs, the described invention may be further modified within the spirit and scope of the disclosure. This application is therefore intended to cover any variations, uses, or adaptations of the invention using its general principles.

Any patent, patent application, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

What is claimed is:

1. A luminaire, comprising:

a geometric solid having a length, the geometric solid comprising:

a first geometric solid portion comprising an optically clear material; and a second geometric solid portion comprising the optically clear material, wherein the first and second geometric solid portions are conjoined;

a cavity defined by the first and second geometric solid portions;

a reflective material positioned in the cavity;

a plurality of discrete light sources positioned to emit light into the cavity;

a first aperture positioned to allow a first portion of light in the cavity to pass into the first geometric solid portion; and a second aperture positioned to allow a second portion of the light in the cavity to pass into the second geometric solid portion.

2. The luminaire of claim 1, wherein:

the first geometric solid portion comprises:

a first curved surface extending the length of the geometric solid; and a first planar surface extending the length of the geometric solid; and the second geometric solid portion comprises:

a second curved surface extending the length of the geometric solid; and a second planar surface extending the length of the geometric solid, wherein a cross-section of the first geometric solid portion is a mirror image of a cross-section of the second geometric solid portion.

3. The luminaire of claim 1, wherein:

the first geometric solid portion has a first lobe-like cross section; and the second geometric solid portion has a second lobe like cross-section, wherein the second lobe-like cross-section is a mirror image of the first lobe-like cross section.

4. The luminaire of claim 1, wherein the cavity extends along the length of the geometric solid.

5. The luminaire of claim 1, wherein the cavity comprises air.

6. The luminaire of claim 1, wherein the cavity comprises another optically clear material.

7. The luminaire of claim 1, wherein at least one of the plurality of discrete light sources comprises a light emitting diode.

8. The luminaire of claim 1, wherein:

the geometric solid defines a longitudinal axis; and the plurality of discrete light sources are aligned with the longitudinal axis.

9. The luminaire of claim 1, wherein:

the geometric solid defines a longitudinal axis; and at least one of the plurality of discrete light sources is offset from the longitudinal axis.

10. The luminaire of claim 1, wherein the reflective material defines at least one of the following:

a first surface of the cavity; and a second surface of the cavity.

11. The luminaire of claim 1, further comprising a reflector positioned to reflect light which exited from the geometric solid back into the geometric solid.

12. The luminaire of claim 11, wherein the reflector is connected to a surface of the geometric solid.

13. The luminaire of claim 11, wherein the reflector is external to the geometric solid.

14. The luminaire of claim 1, further comprising:

a first reflective surface positioned adjacent a first end of the geometric solid; and a second reflective surface positioned adjacent a second end of the geometric solid.

15. A luminaire, comprising:

a substrate;

a geometric solid configured to pass light in the geometric solid toward an environment external to the luminaire, wherein the geometric solid extends along a longitudinal axis of the luminaire and comprises:

a first geometric solid portion comprising an optically clear material, wherein a cross-section of the first geometric solid is bounded by a first curved surface and a first planar surface; and a second geometric solid portion conjoined with the first geometric solid portion, wherein the second geometric solid portion comprises the optically clear material, wherein a cross-section of the second geometric solid portion is bounded by a second curved surface and a second planar surface, and wherein the cross-section of the second geometric solid portion is a mirror-image of the cross-section of the first geometric solid portion;

a first reflective end panel connected to the substrate proximate a first end of the geometric solid;

a second reflective panel connected to the substrate proximate a second end of the geometric solid;

a cavity defined by the first and second geometric solid portions and configured to pass light in the cavity toward the first and second geometric solid portions, wherein the cavity extends along the longitudinal axis of the luminaire and a cross-section of the cavity is a triangular shape;

a diffuse reflector connected to the first curved portion of the first geometric solid portion and the second curved surface of the second geometric solid portion, wherein the diffuse reflector is configured to redirect light exiting the first curved portion of the first geometric solid portion and the second curved surface of the second geometric solid portion toward the environment external to the luminaire, and wherein the diffuse reflector is positioned between the substrate and the cavity;

a plurality of discrete light sources positioned along the longitudinal axis of the luminaire and configured to emit light into the cavity;

a first aperture positioned to allow a first portion of the light in the cavity to pass into the first geometric solid portion; and a second aperture positioned to allow a second portion of the light in the cavity to pass into the second geometric solid portion, wherein at least one of the first reflective end panel, the second reflective end panel and the diffuse reflector comprises a white reflective material.

16. The luminaire of claim 15, further comprising a reflector positioned within the cavity at an apex of the cross-section of the cavity opposite one of the plurality of discrete light sources, wherein the reflector comprises the white reflective material.

17. A luminaire, comprising:

a mounting case;

a geometric solid configured to pass light in the geometric solid toward an environment external to the luminaire, wherein the geometric solid extends along a longitudinal axis of the luminaire and comprises:

a first geometric solid portion comprising an optically clear material, wherein a cross-section of the first geometric solid is bounded by a first curved surface and a first planar-like surface; and a second geometric solid portion conjoined with the first geometric solid portion, wherein the second geometric solid portion comprises the optically clear material, wherein a cross-section of the second geometric solid portion is bounded by a second curved surface and a second planar-like surface, and wherein the cross-section of the second geometric solid portion is a mirror-image of the cross-section of the first geometric solid portion;

a first reflective end panel connected to the mounting case proximate a first end of the geometric solid;

a second reflective panel connected to the mounting case proximate a second end of the geometric solid;

a cavity defined by the first and second geometric solid portions and configured to pass light in the cavity toward the first and second geometric solid portions, wherein the cavity extends along the longitudinal axis of the luminaire and a cross-section of the cavity is a triangular shape;

a diffuse reflector connected to a surface of the mounting case, wherein the diffuse reflector is configured to redirect light exiting the first curved portion of the first geometric solid portion and the second curved surface of the second geometric solid portion toward the environment external to the luminaire, and wherein the diffuse reflector is positioned between the mounting case and the cavity;

a plurality of discrete light sources positioned along the longitudinal axis of the luminaire and configured to emit light into the cavity;

a first aperture positioned to allow a first portion of the light in the cavity to pass into the first geometric solid portion; and a second aperture positioned to allow a second portion of the light in the cavity to pass into the second geometric solid portion, wherein at least one of the first reflective end panel, the second reflective end panel and the diffuse reflector comprises a white reflective material.

18. The luminaire of claim 17, further comprising one of the following:

a first Fresnel lens formed in the first planar-like surface and a second Fresnel lens formed in the second planar-like surface; and a first prismatic array formed in the first planar-like surface and a second prismatic array formed in the second planar-like surface.

19. The luminaire of claim 17, further comprising a reflector positioned within the cavity at an apex of the cross-section of the cavity opposite one of the plurality of discrete light sources, wherein the reflector comprises the white reflective material.

* * * * *